US008588658B2

(12) United States Patent
Uno

(10) Patent No.: US 8,588,658 B2
(45) Date of Patent: Nov. 19, 2013

(54) IMAGE FORMING APPARATUS, DEVELOPER DISCHARGE METHOD, AND COMPUTER PROGRAM PRODUCT THEREOF

(75) Inventor: Mugijirou Uno, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 290 days.

(21) Appl. No.: 12/947,398

(22) Filed: Nov. 16, 2010

(65) Prior Publication Data

US 2011/0129240 A1 Jun. 2, 2011

(30) Foreign Application Priority Data

Dec. 2, 2009 (JP) ..... 2009-274441

(51) Int. Cl.
*G03G 15/08* (2006.01)

(52) U.S. Cl.
USPC ..... 399/257; 399/120

(58) Field of Classification Search
USPC ..... 399/257, 120
See application file for complete search history.

(56) References Cited

U.S. PATENT DOCUMENTS

| | | | | |
|---|---|---|---|---|
| 5,307,123 | A * | 4/1994 | Aimoto | 399/257 |
| 7,110,696 | B2 | 9/2006 | Murakami et al. | |
| 7,272,354 | B2 | 9/2007 | Murakami et al. | |
| 7,280,773 | B2 | 10/2007 | Uno | |
| 7,783,209 | B2 | 8/2010 | Uno et al. | |
| 7,801,467 | B2 | 9/2010 | Uno et al. | |
| 7,991,330 | B2 * | 8/2011 | Oshikawa et al. | 399/254 |
| 8,131,187 | B2 * | 3/2012 | Uno | 399/257 |
| 2006/0083552 | A1 * | 4/2006 | Yoshimoto et al. | 399/257 |
| 2006/0216066 | A1 * | 9/2006 | Kubota et al. | 399/257 |
| 2007/0116494 | A1 | 5/2007 | Uno et al. | |
| 2007/0280742 | A1 | 12/2007 | Matsumoto et al. | |
| 2008/0175628 | A1 | 7/2008 | Kita et al. | |
| 2008/0181630 | A1 | 7/2008 | Matsumoto et al. | |
| 2008/0181670 | A1 | 7/2008 | Tsuda et al. | |
| 2008/0279592 | A1 | 11/2008 | Matsumoto et al. | |
| 2009/0016777 | A1 | 1/2009 | Miyamoto et al. | |

(Continued)

FOREIGN PATENT DOCUMENTS

| | | | |
|---|---|---|---|
| JP | S61-269179 | A | 11/1986 |
| JP | H02-230271 | A | 9/1990 |

(Continued)

OTHER PUBLICATIONS

Office Action mailed Sep. 10, 2013, in Japanese patent application No. 2009-274441, filed Dec. 2, 2009.

*Primary Examiner* — G. M. Hyder
(74) *Attorney, Agent, or Firm* — Oblon, Spivak, McClelland, Maier & Neustadt, L.L.P.

(57) ABSTRACT

An image forming apparatus includes a latent image carrier, a development device, a discharge port through which developer is discharged, a discharge port detector, and a controller that determines whether to permit driving of the development device in a direction reverse to a normal direction or to terminate discharge of developer based on detection results by the discharge port detector in discharge of developer. The development device includes a developer carrier, a developer supply member disposed in a supply compartment facing the developer carrier, a developer collection member disposed in a collection compartment lower than the supply compartment, a developer agitation member disposed in an agitation compartment disposed at a height similar to that of the collection compartment, to transport developer in a direction opposite conveyance direction by the developer supply member and the developer collection member.

14 Claims, 12 Drawing Sheets

(56) References Cited

U.S. PATENT DOCUMENTS

| | | | | |
|---|---|---|---|---|
| 2009/0041508 | A1 | 2/2009 | Oshikawa et al. | |
| 2009/0103935 | A1 | 4/2009 | Uno et al. | |
| 2009/0110425 | A1 | 4/2009 | Uno et al. | |
| 2009/0180813 | A1 | 7/2009 | Yoneda et al. | |
| 2009/0214267 | A1 | 8/2009 | Uno | |
| 2009/0232526 | A1 | 9/2009 | Yoneda et al. | |
| 2009/0245879 | A1 * | 10/2009 | Minami et al. | 399/255 |
| 2010/0040391 | A1 | 2/2010 | Uno | |

FOREIGN PATENT DOCUMENTS

| | | | |
|---|---|---|---|
| JP | 3-9389 | | 1/1991 |
| JP | H05-341639 | A | 12/1993 |
| JP | 6-230668 | | 8/1994 |
| JP | 11-272062 | | 10/1999 |
| JP | 2001-117365 | | 4/2001 |
| JP | 2009-198841 | A | 9/2009 |

* cited by examiner

IMAGE FORMING APPARATUS, DEVELOPER DISCHARGE METHOD, AND COMPUTER PROGRAM PRODUCT THEREOF

CROSS-REFERENCE TO RELATED APPLICATIONS

This patent specification is based on and claims priority from Japanese Patent Application No. 2009-274441, filed on Dec. 2, 2009 in the Japan Patent Office, which is hereby incorporated by reference herein in its entirety.

BACKGROUND OF THE INVENTION

1. Field of the Invention

The present invention generally relates to an electrophotographic image forming apparatus, such as a copier, a printer, a facsimile machine, or a multifunction machine having at least two of these capabilities, a method of discharging developer from a development device, and a computer program product thereof.

2. Description of the Background Art

Two-component developer consisting essentially of toner and carrier is widely used in electrophotographic image forming apparatuses. Two-component developer is degraded over time while being used in image development and typically comes to the end of its useful life after being used in image development of several hundreds of thousands to several millions of sheets of recording media. If degraded developer is not replaced with fresh developer but is used in subsequent image formation, toner particles therein are not charged sufficiently and can be scattered in the backgrounds of output images or around the interior of the apparatus. Therefore, degraded developer must be removed from the development device, after which the development device is filled with fresh developer to prevent such image failure or contamination of the image forming apparatus.

Several approaches have been tried to remove developer from the development device efficiently and to reduce the time required to do so.

For example, to remove developer from the development device, JP-H06-230668-A proposes rotating developer conveyance members such as screws in a direction reverse to the direction in which the development device is usually driven. More specifically, JP-H06-230668-A discloses a method of discharging developer from a developer container in a development device including two screws for transporting developer, and a development roller serving as a developer carrier.

In this method, when developer is discharged from the development device through a developer discharge port formed therein, the screws are rotated in the reverse direction (hereinafter "reverse rotation") to their normal rotational direction in image formation so as to discharge developer accumulated on the bottom of the developer container. Subsequently, developer adhering to the development roller is scraped off by a scraper and falls to the bottom of the developer container with the development roller rotated in the normal direction. Then, the screws are rotated in the reverse direction to discharge the developer thus scraped off outside the development device.

It is to be noted that, differently from such development devices, development devices may include a developer container divided into, for example, three compartments (i.e., supply, collection, and agitation compartments) and three corresponding screws, (i.e., supply, collection, and agitation screws), each having a different capability, in addition to the development roller. The collection compartment receives developer from the development roller, and the collection screw provided therein transports the developer collected from the development roller to the agitation compartment. Because toner included in the developer is consumed in image development and accordingly the concentration of toner in the collected developer is reduced, toner is supplied to the collected developer. The agitation screw provided in the agitation compartment mixes the supplied toner and the collected developer so that the mixture has a uniform toner concentration similar to that of developer before image development. The supply screw provided in the supply compartment then supplies the developer having a uniform toner concentration to the development roller.

If the method of the above-described approach is applied to such development devices having three screws and the rotational direction of the screws is reversed abruptly, the developer collected from the development roller and the developer transported reversely by the supply screw are present in the supply compartment at the same time. In other words, a large amount of developer is present in the supply compartment, and with this sudden influx of developer, the supply screw may be damaged by the confluence of the collected developer and the developer transported by the supply screw. Moreover, even if the supply screw is not damaged, such a large amount of developer can impart a mechanical impact to toner in the developer, thus causing toner therein to coagulate. If remaining in the development device after fresh developer is supplied thereto, the coagulated toner is mixed with the fresh toner, thus producing cores of toner. The number of cores of toner can be amplified and degrade image quality. Thus, it is not possible to apply the above-described known method as is to development devices including three developer conveyance members.

Additionally, it is possible that an intermediate transfer belt might be damaged. Because toner contributes to lubrication of photoconductor drums (image carriers), when toner is not supplied to the photoconductor drum after developer is discharged from the development device, the photoconductor drum and the intermediate transfer belt can be left in direct contact with each other for a long time. As a result, not only the photoconductor drum but also the intermediate transfer belt can be damaged.

By contrast, it is possible that it can take long to discharge developer by rotating the three screws only in the normal direction in development in which developer is supplied upward from the supply compartment to the development roller. More specifically, in such development devices, developer should be accumulated in a downstream end portion of the supply compartment by the screw rotating in the normal direction (hereinafter "normal rotation") to be pushed up from the supply compartment to the development roller against the force of gravity. Therefore, efficiency in removal of developer will decrease after the amount of developer remaining in the development device is reduced substantially. Moreover, when the amount of developer in the development device is substantially reduced, there can be toner particles separated from developer in the development device, and it is difficult to discharge such separated toner particles outside the device.

Therefore, the inventor of the present invention recognizes that there is a need to reduce time required for removal of developer from the development device and downtime of the image forming apparatus without damaging the apparatus, which known approaches fail to do.

SUMMARY OF THE INVENTION

In view of the foregoing, one illustrative embodiment of the present invention provides an image forming apparatus capable of discharging developer therefrom efficiently.

The image forming apparatus includes an image forming unit including a latent image carrier and a development device to develop a latent image formed on the latent image carrier with developer. The development device includes a developer carrier disposed facing the latent image carrier, to carry the developer to the latent image carrier by rotation, a partition dividing an interior of the development device into a supply compartment, a collection compartment, and an agitation compartment, a developer supply member disposed in the supply compartment, a developer collection member disposed in the collection compartment, a developer agitation member disposed in the agitation compartment, a discharge port through which the developer is discharged outside the development device, a discharge port detector to detect whether the discharge port is open, and a controller for performing discharge of developer form the development device, operatively connected to the development device and the discharge port detector.

The supply compartment faces the developer carrier, the collection compartment is disposed lower than the supply compartment and faces the developer carrier, and the agitation compartment is disposed at a height similar to that of the collection compartment. The agitation compartment faces the supply compartment as well as the collection compartment and receives excessive developer from a downstream end portion of the supplying compartment as well as collected developer from a downstream end portion of the collection compartment in the developer conveyance direction. The developer supply member supplies the developer to the developer carrier while transporting the developer in an axial direction of the developer carrier, and the developer collection member transports the developer separated from the developer carrier in a developer conveyance direction identical to the direction in which the developer supply member transports the developer. The developer agitation member mixes together the excessive developer and the collected developer and transports the mixed developer in a direction opposite the direction in which the developer supply member transports the developer. In the discharge of developer, the controller determines whether to permit driving of the development device in a direction reverse to a normal direction in which the development device is driven in image formation or to terminate the discharge of developer based on detection results obtained by the discharge port detector.

Another illustrative embodiment of the present invention provides a method of discharging developer from a discharge port formed in a development device installed in an image forming apparatus. The method includes a step of driving the development device for a predetermined period in a normal direction in which the development device is driven in image formation, a step of detecting whether the discharge port is open or closed, a step of determining whether to permit driving of the development device in a direction reverse to the normal direction or to terminate the discharge of developer based on whether or not the discharge port is open, and a step of driving the development device in a reverse direction opposite the normal direction when the discharge port is open.

Yet another illustrative embodiment provides a computer program product including a computer-readable storage medium having a computer-readable program stored thereon and which, when executed by a computer, causes the computer to carry out the method described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
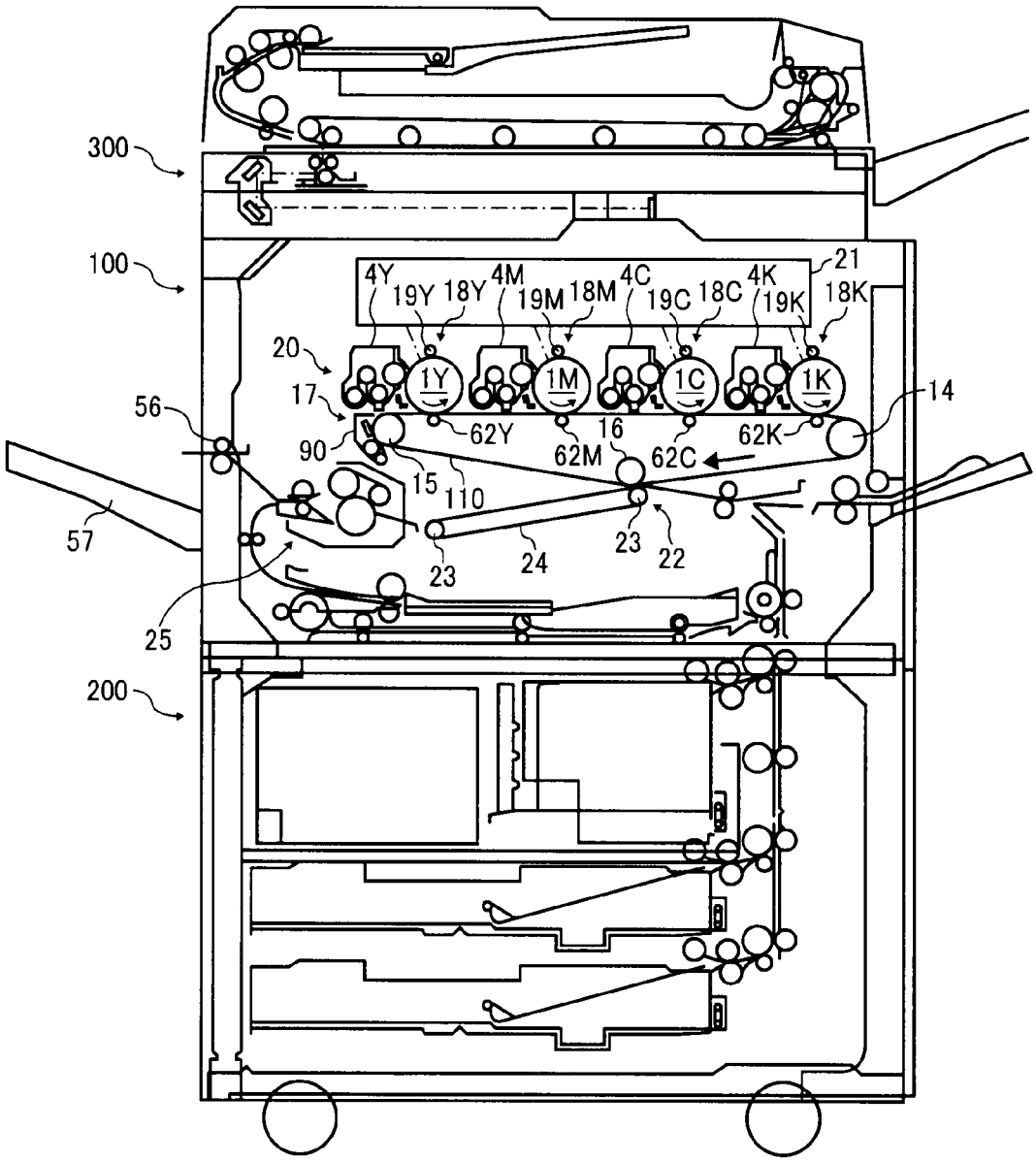
FIG. 1 is a schematic view illustrating a configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a tandem-type multicolor image forming apparatus according to an illustrative embodiment of the present invention is described.

FIG. 1 is a schematic view illustrating a configuration of an image forming apparatus according to an illustrative embodiment of the present invention.

The image forming apparatus that in the present embodiment is a tandem-type multicolor image forming apparatus using an intermediate transfer belt is described below.

Referring to FIG. 1, the image forming apparatus according to the present embodiment includes a main body 100, a sheet feeder 200 disposed beneath the main body 100, and a scanner 300 disposed above the main body 100. In the main body 100, photoconductor drums 1Y, 1M, 1C, and 1K are provided above an intermediate transfer belt 110 and arranged in that order from the left in FIG. 1. It is to be noted that the subscripts Y, M, C, and K attached to the end of each reference numeral indicate only that components indicated thereby are used for forming yellow, magenta, cyan, and black images, respectively, and hereinafter may be omitted when color discrimination is not necessary. In FIG. 1, the photoconductor drums 1Y, 1M, 1C, and 1K rotate counterclockwise, and the intermediate transfer belt 110 rotates clockwise. In addition, a charging member 19, a development device 4, a discharging member (a QL lamp 506 in FIG. 5), and so forth are provided around each photoconductor drum 1 and together form a process cartridge 18 for each color. At least two of the components of the image forming unit 18 may be held in a single unit housing as a process cartridge that is removably installable in the main body 100. Four process cartridges 18 together form a tandem image forming unit 20.

Figure 4:
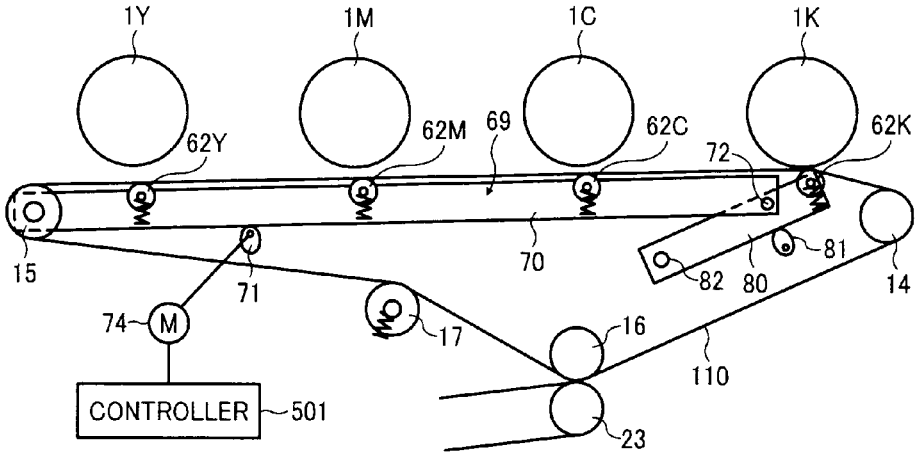
FIG. 4 illustrates an initial state of the image forming apparatus in which an intermediate transfer belt is in contact with only a photoconductor for black.

In an initial state, the intermediate transfer belt 110 is in contact with only the photoconductor drum 1K and is disengaged from the photoconductor drums 1Y, 1M, and 1C as shown in FIG. 4. Image formation is performed in this state in monochrome mode and is performed with the intermediate transfer belt 110 engaged with the photoconductors drums 1Y, 1M, 1C in addition to the photoconductor drum 1K in multicolor mode. Keeping the photoconductor drums 1Y, 1M, and 1C disengaged from the intermediate transfer belt 110 in the monochrome mode can prevent or reduce deterioration of these photoconductor drums 1 caused by contact with the intermediate transfer belt 110. Moreover, the photoconductor drums 1Y, 1M, and 1C may be deactivated so as to expand operational lives of the charging members 19, the development devices 4, and the discharging members, drum cleaning units, and so forth as well as those of the photoconductor drums 1Y, 1M, and 1C. Additionally, the intermediate transfer belt 110 is also disengaged from the photoconductor drum 1K while the development device 4 is filled with developer. Engagement and disengagement of the intermediate transfer belt 110 from the photoconductor drums 1 are described in fifth through seventh embodiments described later.

The image forming apparatus further includes an optical writing unit 21 and a belt cleaning unit 90 positioned around the image forming units 18, each of which includes the photoconductor drum 1. The intermediate transfer belt 110 is stretched around a driving roller 14 and tension rollers 15 and 16. The intermediate transfer belt 110 and primary-transfer rollers 62, provided on an inner side of the intermediate transfer belt 110 at positions facing the respective photoconductor drums 1, together form an intermediate transfer unit 17. Additionally, the intermediate transfer belt 110 is pressed against a conveyance belt 24 stretched around two rollers 23, and one of the rollers 23 pressed against the intermediate transfer belt 110 via the conveyance belt 24 serves as a secondary-transfer roller. The secondary-transfer roller 23 and the conveyance belt 24 together form a secondary-transfer portion 22 where an image (i.e., toner image) is transferred from the intermediate transfer belt 110 onto a sheet of recording media transported thereto, timed to coincide with the image formed on the intermediate transfer belt 110. The sheet carrying the toner image is then conveyed to a fixing device 25, where the toner image is fixed on the sheet with heat and pressure, after which the sheet is discharged by a pair of discharge rollers 56 onto a discharge tray 57. Meanwhile, the belt cleaning unit 90, positioned downstream from the secondary-transfer portion 22 in a rotational direction of the intermediate transfer belt 110, removes any toner remaining on the intermediate transfer belt 110. Images are formed on sheets of recording media by repeating these image forming processes.

The image forming apparatus according to the present embodiment uses two-component developer consisting essentially of toner (toner particles) and carrier (carrier particles). After being used in image development of several hundreds of thousands to several millions of sheets of recording media, two-component developer typically comes to the end of its useful life. Because toner particles in the degraded developer are not charged sufficiently and can be scattered in the backgrounds of output images or around the interior of the apparatus, degraded developer must be replaced with fresh developer to prevent such image failure or contamination of the apparatus.

Next, the development device 4 is described below with reference to FIGS. 2A, 2B, and 3.

Figure 2A:
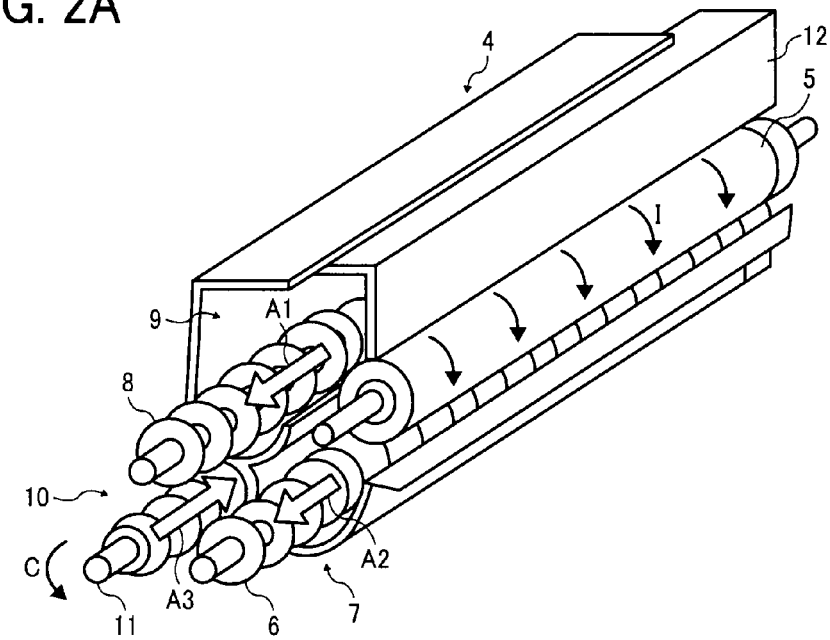
FIG. 2A is a perspective view of a development device in which directions of flow of developer are shown.
Figure 2B:
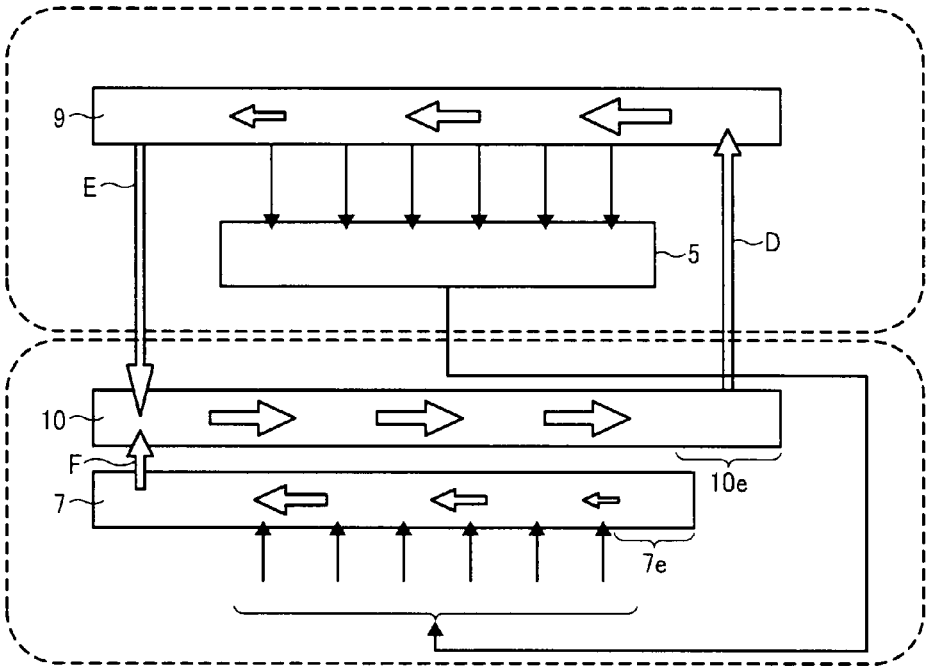
FIG. 2B is a cross-sectional view of the development device along its axial direction.

FIG. 2A is a perspective view of the development device 4 viewed obliquely, and FIG. 2B is a cross-sectional view of the development device 4 along an axial direction of the development device 4. FIG. 3 is a cross-sectional view illustrating the development device 4 and the photoconductor drum 1. In FIG. 3, the photoconductor drum 1 rotates counterclockwise in FIG. 3 as indicated by arrow G.

It is to be noted that the image forming units 18Y, 18M, 18C, and 18K have a similar configuration.

Figure 3:
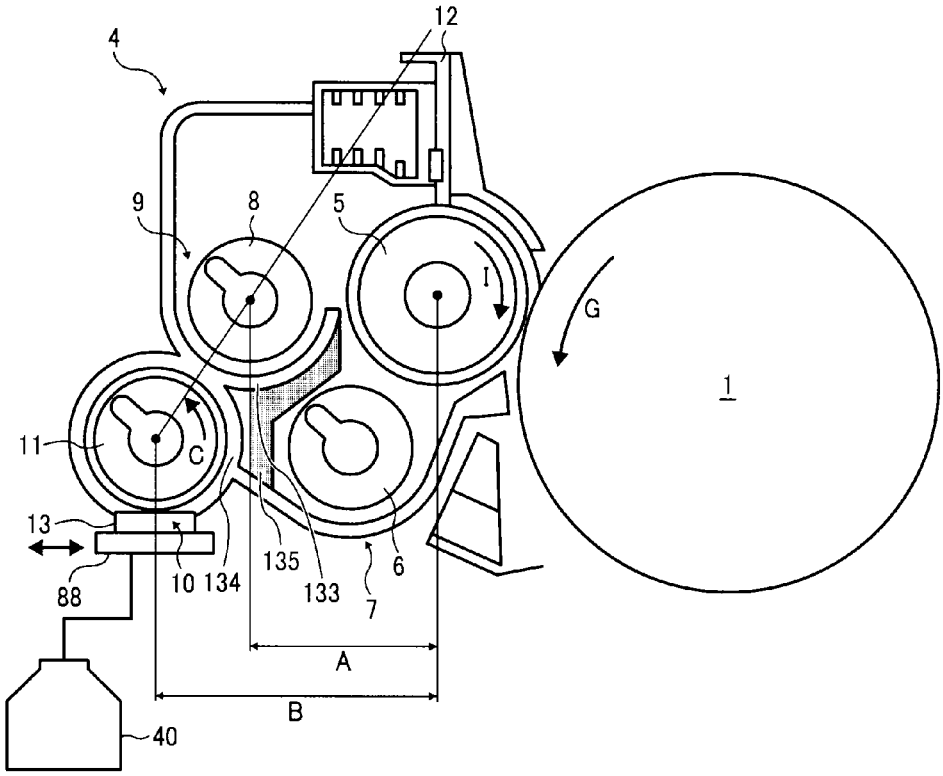
FIG. 3 is a cross-sectional view illustrating the development device and a photoconductor drum.

Referring to FIG. 3, the development device 4 in the present embodiment includes a casing serving as a developer container in which developer is contained, three screws provided in the developer container, serving as developer conveyance members for transporting developer, namely, a collection screw 6, a supply screw 8, and an agitation screw 11, and a development roller 5 serving as a developer carrier. The developer container is divided into three developer conveyance compartments. In the present embodiment, waste developer is discharged through a discharge port 13 formed in the development device 4 and collected in a waste developer container 40. The discharge port 13 can be opened or closed with a shutter 88 automatically by a controller 501 (shown in FIG. 5). The shutter 88 opens and closes in the direction indicated by an arrow on the left of the shutter 88 in FIG. 3. The development device 4 used in the image forming apparatus according to the present embodiment can adopt a configuration in which the development roller 5 and the three screws, 6, 8, and 11 are arranged in a diamond shape on a cross section in which axes of rotation of the development roller 5 and the screws 6, 8, and 11 are cut vertically.

Referring to FIG. 2A, when the screws 6, 8, and 11 rotate in their normal directions (hereinafter "normal rotation") indicated by the respective arrows shown in FIG. 3, the developer is transported in directions indicated by outlined arrows A1, A2, and A3 shown in FIG. 2A.

It is to be noted that the development roller 5 as well as the screws 6, 8, and 11 are rotated also in the reverse directions when developer is removed from the development device 4.

The development device 4 is described in further detail below with reference FIG. 3.

The development roller 5 serves as a developer carrier and supplies toner to an electrostatic latent image formed on the photoconductor drum 1 for developing it while the surface thereof moving in the direction indicated by arrow I in FIGS. 2A and 3. While supplying the toner to the development roller 5, the supply screw 8 transports the developer toward a back side of paper on which FIG. 3 is drawn, that is, in a direction perpendicular to and rearward of the paper on which FIG. 3 is drawn.

The amount of developer supplied to the development roller 5 is adjusted to a desired or given layer thickness by a developer doctor 12, serving as a developer regulator, positioned downstream from a portion where the development roller 5 faces the supply screw 8 in the rotational direction of the development roller 5, indicated by arrow I.

The collection screw 8, serving as a developer collection member, is positioned downstream from a development area where the development roller 5 faces the photoconductor drum 1 in the rotational direction of the development roller 5 for collecting the developer that has passed through the development area and for transporting the collected developer in the direction identical to the direction in which the supply screw 8 transports the developer (hereinafter "developer conveyance direction"). The developer container includes a supply compartment 9 (i.e., a supply path) in which the supply screw 8 is provided, positioned on a side of the development roller 5, and a collection compartment 7 (i.e., collection path) in which the collection screw 6 is provided, positioned beneath the development roller 5 and the supply compartment 9.

In the present embodiment, the developer container further includes an agitation compartment 10 (i.e., agitation path), positioned beneath the supply compartment 9 and on a side of the collection compartment 7. The collection compartment 7 includes the agitation screw 11 that transports the developer toward a front side of paper on which FIG. 3 is drawn, which is a direction opposite the developer transport direction of the supply screw 8, while agitating the developer.

The development device 4 further includes a first separation wall 133 that includes a portion separating the supply compartment 9 from the agitation compartment 10. Although separated by the first separation wall 133, the supply compartment 9 and the agitation compartment 10 communicates with each other in both end portions in the direction perpendicular to the surface of paper on which FIG. 3 is drawn, through openings, namely, a first communication portion and a third communication portion respectively formed on the front side and the back side of the paper. It is to be noted that the supply compartment 9 and the collection compartment 7 are separated by the first separation wall 133 as well, and an opening through which the supply compartment 9 communicates with the agitation compartment 7 is not formed in the first separation wall 133. The development device 4 further includes a second separation wall 134 that includes a portion separating the agitation compartment 10 from the collection compartment 7. Although separated by the second separation wall 134, an opening (second communication portion) through which the agitation compartment 10 communicates with the collection compartment 7 is formed in the second separation wall 134, in an end portion, that is, on the front side of paper on which FIG. 3 is drawn. In the present embodiment, the supply screw 8, the collection screw 6, and the agitation screw 11, serving as the developer conveyance members, can be made of resin and have a diameter of about 18 mm and a screw pitch of about 25 mm. The rotational frequency of the screws 6, 8, and 11 is greater than 600 rpm. It is to be noted that these values are only examples and characteristics of the screws are not limited thereto.

The developer carried on the development roller 5, regulated to a desirable thickness by the developer doctor 12, is conveyed to the development area facing the photoconductor drum 1 for image development. The development roller 5 can be formed of an aluminum cylinder having a diameter of about 25 mm, and V grooves are formed in the surface of the development roller 5. Alternatively, the surface of the development roller 5 may be sandblasted. The gap between the developer doctor 12 and the photoconductor drum 1 may be about 0.3 mm. After being used in image development, the developer is collected in the collection compartment 7 and then is conveyed to the front side of paper on which FIG. 3 is drawn. The collected developer is further conveyed through the opening (second communication portion) formed in the first separation wall 133, in a non-image area, to the agitation compartment 10. It is to be noted that toner is supplied to the agitation compartment 10 through a toner supply port (not shown) formed on an upper side of the agitation compartment 10, positioned close to the opening formed in the first separation wall 133.

Next, circulation of the developer inside the three compartments in the developer container is described below.

FIG. 2A is a perspective view of the development device 4 with an interior of the developer container exposed, and directions of movement of the developer are indicated by arrows. FIG. 2B is a schematic view that illustrates flow of the developer inside the development device 4, in which directions of movement of the developer are indicated by arrows.

The developer is supplied from the agitation compartment 10 to the supply compartment 9 and then is transported by the supply screw 8 downstream in the direction indicated by arrow A1. Then, the developer that is not supplied to the development roller 5 but is transported to a downstream end portion of the supply compartment 9 in the direction indicated by arrow A1 (hereinafter "excessive developer") is transported through the opening (first communication portion) formed in the first separation wall 133 to the agitation compartment 10 as indicated by arrow E shown in FIG. 2B.

The developer collected from the development roller 5 in the collection compartment 7 is transported by the collection screw 6 to a downstream end portion of the collection compartment 7 in the direction indicated by arrow A2, after which the collected developer is transported to the agitation compartment 10 through the opening or second communication portion as indicated by arrow F shown in FIG. 2B. In the agitation compartment 10, the excessive developer and the collected developer are mixed together and transported by the agitation screw 11 to a downstream end portion 10*e* in the direction indicated by arrow A3, which is on an upstream side in the conveyance direction of the supply screw 8. Then, the developer is transported through the opening formed in the first separation wall 133 to the supply compartment 9 as indicated by arrow D shown in FIG. 2B.

In the agitation compartment 10, the agitation screw 11 transports the collected developer, the excessive developer, and toner supplied as required in the direction opposite the direction in which the developer is transported in the collection compartment 7 as well as the supply compartment 9. Subsequently, the developer is transported from a downstream end portion of the agitation compartment 10 to an upstream end portion of the supply compartment 9 through the opening or third communication portion. It is to be noted that, a toner concentration detector or ST sensor 510 (shown in FIG. 5) is provided beneath the agitation compartment 10, and toner is supplied by a toner supply device (not shown) from a toner container (not shown) according to output from the toner concentration detector 510.

In the development device 4 shown in FIG. 2B, the used developer does not directly enter the supply compartment 9 because supply and collection of developer are performed in the supply compartment 9 and the collection compartment 7, respectively. Therefore, decreases in concentration of toner in the developer on the downstream side in the supply compartment 9 can be prevented or reduced. Additionally, collection and agitation of developer are performed in different developer conveyance compartments, namely, the collection compartment 7 and the agitation compartment 10, which can prevent the used developer from being supplied to the development roller 5 during agitation. Therefore, only sufficiently agitated developer is allowed to enter the supply compartment 9. In other words, decreases in concentration of toner in the developer in the supply compartment 9 can be prevented or alleviated, and accordingly image density can be kept constant.

It is to be noted that, as shown in FIG. 2B, upward movement of the developer in the development device 4 is limited to the movement indicated by arrow D from the agitation compartment 10 to the supply compartment 9. As the agitation screw 11 rotates, developer is pressed to the downstream side of the agitation compartment 10 and is piled up. Accordingly, the developer is transported upward to the supply compartment 9 as indicated by arrow D shown in FIG. 2B. While thus pressed and transported upward, the developer can receive stress, which shortens the useful life of the developer. Additionally, due to the stress to the developer, film of carrier particles can be scraped off and toner particles can be degraded, resulting in decreases in image quality. Therefore, it is preferred to alleviate stress to the developer caused by upward movement of developer indicated by arrow D to expand useful life of developer. Additionally, alleviating stress to the developer can reduce deterioration of developer. As a result, satisfactory image quality can be maintained with fluctuations in image density reduced.

In view of the foregoing, as shown in FIG. 3, the supply compartment 9 is positioned obliquely above the agitation compartment 10 in the development device 4 according to the present embodiment. With this arrangement, stress to the developer caused by the upward movement, indicated by arrow D shown in FIG. 2B, can be reduced compared with a configuration in which the supply compartment 9 is positioned vertically above the agitation compartment 10. In addition, as shown in FIG. 3, by arranging the supply compartment 9 and the agitation compartment 10 obliquely in a vertical direction, a surface of an upper wall of the agitation compartment 10 is higher than a surface of a bottom wall of the supply compartment 9. Although disposing the supply compartment 9 higher than the agitation compartment 10 means transporting the developer upward by the pressure exerted by the agitation screw 11 against the force of gravity, resulting in stress to the developer, the stress to the developer can be reduced by disposing the upper wall of the agitation compartment 10 higher than the surface of the bottom wall of the supply compartment 9 because the developer at a highest position in the agitation compartment 10 can flow to a lowest position in the supply compartment 9 without flowing against the force of gravity.

It is to be noted that a fin member may be provided on a shaft of the agitation screw 11 in the third communication portion where the agitation compartment 10 communicates with the supply compartment 9, positioned on the downstream side in the developer conveyance direction in the agitation compartment 10. The fin member may be a planar member defined by sides in parallel to the axial direction of the agitation screw 11 and sides perpendicular to the axial direction of the agitation screw 11. By agitating up the developer with the fin member, the developer can be transported more efficiently from the agitation compartment 10 to the supply compartment 9.

In addition, referring to FIG. 3, the relative positions of the supply compartment 9 and agitation compartment 10 are set so that a distance A between the axial centers of the development roller 5 and the supply compartment 9 (supply screw 8) is shorter than a distance B between the axial centers of the development roller 5 and the agitation compartment 10. This arrangement can facilitate reliable supply of developer from the supply compartment 9 to the development roller 5 as well as compactness of the development device 4. Additionally, the agitation screw 11 rotates counterclockwise as indicated by arrow C shown in FIG. 3 when viewed from the front side of paper on which FIG. 3 is drawn, and accordingly the developer in the agitation compartment 10 is brought up on the right side in FIG. 3 toward the supply compartment 9 along the shape of the agitation screw 11. As a result, the developer can be brought up efficiently, thus reducing stress to the developer. Additionally, as shown in FIG. 3, the development device 4 according to the present embodiment can further include a fill-in member 135 disposed in the collection compartment 7 for filling a gap in the collection compartment 7. The fill-in member 135 extends from the upstream side to a center portion in the developer conveyance direction in the collection compartment 7, that is, the axial direction. The fill-in member 135 extends from the second separation wall 134 to the first separation wall 133 so as to cover the collection screw 6. Filling the gap in the upstream portion in the collection compartment 7, from the upstream side at least to the center portion, in the developer conveyance direction therein with the fill-in member 135 can reduce the cross-sectional area on the upstream side from the cross-sectional area on the downstream side in the collection compartment 7 in the developer conveyance direction therein.

This configuration can prevent the ratio of the gap on the downstream side of the collection compartment 7 from being reduced from that on the upstream side of the developer conveyance direction therein in a state in which the amount of developer is greater on the downstream side than on the upstream side in the collection compartment 7 in the developer conveyance direction therein. This configuration can also prevent the inner pressure on the downstream side of the collection compartment 7 from increasing from that on the upstream side thereof in the developer conveyance direction therein. Although air flows into the gap between the development roller 5 and the casing, downstream from the development area in the rotational direction of the development roller 5, as the development roller 5 rotates, the above-described configuration can inhibit air flowing into the gap (hereinafter "inflow air") from converging into the upstream portion of the collection compartment 7, thus restricting the amount of air flowing into the upstream portion. As a result, drop in pressure in the downstream portion of the collection chamber 7 in the developer conveyance direction therein, caused by the inflow air, can be restricted. Accordingly, the pressure by the inflow air on the downstream side in the collection compartment 7 can be kept higher than the inner pressure on the downstream side therein. This configuration can prevent or restrict airflow flowing out toward the photoconductor drum 1 from the gap between the development roller 5 and the casing downstream from the development area in the rotational direction of the development roller 5, and thus toner can be prevented from being scattered. Alternatively, the shape and size of the fill-in member 135 may be determined so that the ratio of the gap at respective positions in the collection compartment 7 can be kept similar based on the amount of developer at the respective positions therein, which can be preliminarily obtained experimentally. With such a configuration, substantially constant inner pressure can be maintained inside the collection compartment 7, and accordingly the inflow air can be prevented from converging into the upstream portion of the collection compartment 7 reliably. Further, the first separation wall 133 and/or the second separation wall 134 may be tapered so that the cross-sectional area of the collection compartment 7 increases downstream in the developer conveyance direction therein.

Moreover, by designing the collection screw 6 so that the developer conveyance velocity is faster on the downstream side than that on the upstream side in the collection compartment 7, the ratio of gap on the downstream side in the collection compartment 7 can be better prevented from decreasing from that on the upstream side therein. In the present embodiment, it is preferable that the collection screw 6 rotate at a velocity equal to or greater than 600 rpm. The collection screw 6 rotates at such a high velocity of 690 rpm or 729 rpm, for example. When the collection screw 6 rotates at high velocity equal to or greater than 600 rpm, it is experimentally known that the developer conveyance velocity can be faster on the downstream side than on the upstream side by setting the screw pitch of the collection screw 6 shorter on the downstream side than on the upstream side in the conveyance direction of the collection screw 6. Therefore, in the case of the collection screw 6 that rotates at high velocity equal to or greater than 600 rpm, by setting the screw pitch of the collection screw 6 shorter on the downstream side than on the upstream side, the amount of developer can be smaller on the downstream side in the developer conveyance direction compared with a configuration in which the developer conveyance velocity is uniform in the axial direction of the collection screw 6. Thus, by designing the collection screw 6 so that the developer conveyance velocity is faster on the downstream side than the upstream side in the developer conveyance direction, the amount of developer can be smaller on the downstream side in the developer conveyance direction compared with a configuration in which the developer conveyance velocity is uniform in the axial direction of the collection screw 6. Therefore, the ratio of gap on the downstream side in the collection compartment 7 can be better prevented from decreasing from that on the upstream side therein.

Additionally, because the cross-sectional area of collection compartment 7 is greater on the downstream side than the upstream side, the gap on the downstream side of the collection compartment 7 can be prevented from being reduced from that on the upstream side of the developer conveyance direction therein even when the amount of developer is greater on the downstream side than the upstream side in the collection compartment 7 in the developer conveyance direction therein. This configuration can also contribute to keeping the inner pressure in the collection compartment 7 constant, which can inhibit the inflow air flowing into the gap between the development roller 5 and the casing from converging into the upstream portion of the collection compartment 7. As a result, drop in pressure in the downstream portion of the collection chamber 7 in the developer conveyance direction therein, caused by the inflow air, can be restricted. Accordingly, the pressure by the inflow air on the downstream side in the collection compartment 7 can be kept higher than the inner pressure on the downstream side therein. This configuration can prevent or restrict airflow flowing out toward the photoconductor drum 1 from the gap between the development roller 5 and the casing downstream from the development area in the rotational direction of the development roller 5, and thus toner can be prevented from being scattered.

Next, a mechanism for engaging and disengaging the intermediate transfer belt 110 from the photoconductor drums 1 is described below.

FIG. 4 illustrates the initial state in which the intermediate transfer belt 110 is in contact with only the photoconductor 1K for black.

In the state shown in FIG. 4, the intermediate transfer belt 110 is disengaged from other photoconductor drums 1Y, 1M, 1C than the photoconductor drum 1K. Referring to FIG. 4, an engagement and disengagement mechanism 69 for engaging and disengaging the intermediate transfer belt 110 from the photoconductor drums 1 includes a first pivotable arm 70, a cam 71, a second pivotable arm 80, and an eccentric cam 81. The first pivotable arm 70 and the cam 71 are used for disengaging the intermediate transfer belt 110 from the photoconductor drums 1Y, 1M, and 1C simultaneously. The second pivotable arm 80 and the eccentric cam 81 are used for disengaging the intermediate transfer belt 110 from the photoconductor drum 1K. A first end (on the right in FIG. 4) of the first pivotable arm 70 is pivotally supported by a support member 72 positioned between the primary-transfer roller 62K and a center portion of the second pivotable arm 80 in a longitudinal direction thereof. As the second pivotable arm 80 itself pivots, the support member 72 pivots as well. A second end (on the left in FIG. 4) of the first pivotable arm 70, the tension roller 15 is provided. A cam 17 is provided between the tension roller 15 and a center portion of the first pivotable arm 70 in the longitudinal direction of the first pivotable arm 70, on the side opposite the primary-transfer rollers 62. The first pivotable arm 70 is in contact with the cam 17 and pivots about the support member 72 as the cam 71 rotates. The cam 71 is rotated by a driving motor 74 controlled by control signals from the controller 501. For example, when the cam 71 rotates 180 degrees from a state in which the primary-transfer rollers 62Y, 62M, and 62C respectively press against the photoconductor drums 1Y, 1M, and 1C via the intermediate transfer belt 110, the first pivotable arm 70 pivots about the support member 72 downward in FIG. 4, and the primary-transfer rollers 62Y, 62M, and 62C move away from the photoconductor drums 1Y, 1M, and 1C, respectively. Thus, the intermediate transfer belt 110 moves away from the photoconductor drums 1Y, 1M, and 1C. Consequently, the intermediate transfer belt 110 is disengaged from the three photoconductors 1 and becomes the initial state. In this state, monochrome images can be formed.

Figure 5:
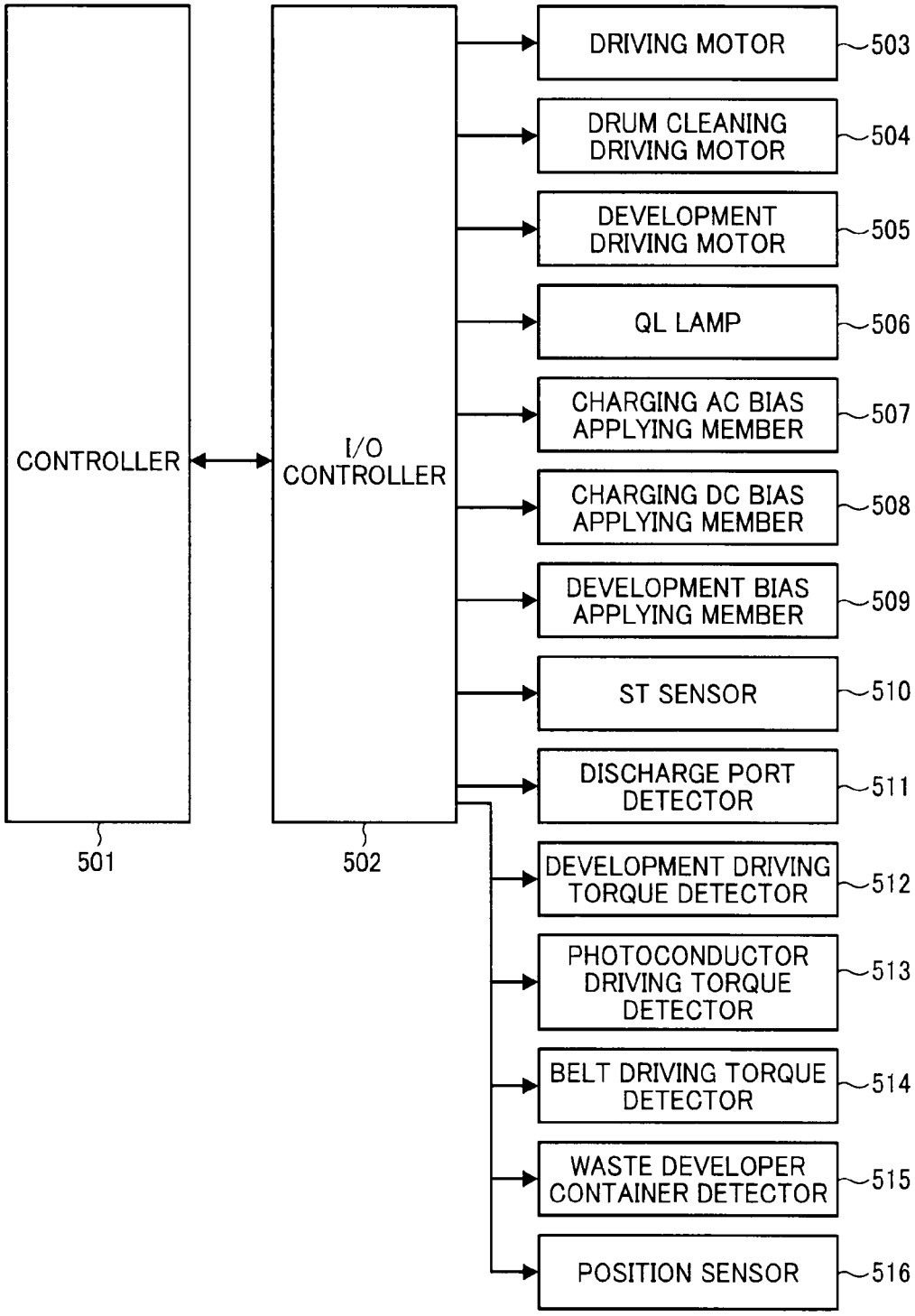
FIG. 5 is a block diagram illustrating a configuration of a control system of the image forming apparatus.

Next, a control system for controlling the mechanism inside the main body 100 of the image forming apparatus is described below with reference to FIG. 5 that is a block diagram illustrating a configuration of the control system.

The controller 501 controls the image forming apparatus including the scanner 300 and so forth entirely, and an input/output (I/O) controller 502 to which various loads in driving systems, sensors, and the like are connected is connected to the controller 501 through a bus. Examples of the loads in the driving systems and sensors connected to the I/O controller 502 are as follows.

The loads in the driving systems includes a first driving source or driving motor 503 for driving the photoconductor drums 1 and the charging members (i.e., charging rollers) 19, a second driving source or intermediate-transfer driving motor (not shown) for driving the intermediate transfer belt 110, a drum cleaning driving motor 504 for the drum cleaning units, a development driving motor 505 for driving the screws in the development device 4, a power source (not shown) for turning on a QL lamp (discharging lamp) 506, a third driving source or an engagement and disengagement motor (not shown) for rotating the cam 71 of the engagement and disengagement mechanism 69, a charging alternating-current (AC) bias applying member 507, a charging direct current (DC) bias applying member 508, and a development bias applying member 509 for applying bias between the development roller 5 in each development device 4 and the corresponding photoconductor drum 1. The charging AC bias applying member 507 and the charging DC bias applying member 508 are for applying bias to the charging members 19.

The sensors includes an ST sensor 510 that is a magnetic sensor for detecting whether or not a certain amount of developer remains in the development device 4, an discharge port detector 511 for detecting directly or indirectly whether the discharge port 13 through which used developer is discharged is open or closed, a disengagement detector 94 (shown in FIG. 13) for detecting whether the intermediate transfer belt 110 engages or is disengaged from the respective photoconductor drums 1, a development driving torque detector 512 (first torque detector), a photoconductor driving torque detector 513 (second torque detector), a belt driving torque detector 514 (third torque detector) for detecting driving torque of the intermediate transfer belt 110, a waste developer container detector 515 for detecting the presence of a waste developer container 40, and a position sensor 516 for detecting the position of the intermediate transfer belt 110.

Further, input ports through which detected values of driving torque of the development devices 4 and driving torque of the driving motor 503 for the photoconductor drums 1 are provided.

It is to be noted that the controller 501 may be a computer including a central processing unit (CPU) and a memory. The computer performs various types of control processing according to programs stored in the memory as functions of the controllers 501. The memory of the computer serves as a computer-readable recording medium that stores those programs. The computer-readable recording medium may be magnetic discs such as portable floppy discs, memories such as NAND (inverted AND) memories, or optical recording media such as CS-ROMs (Compact Disc Read Only Memories), CD-RWs (Compact Disc-ReWritables), CD-Rs (Compact Disc-Recordables), or DVD-RAMs (Random Access Memories). Alternatively, those programs may be stored in fixed recording media such as hard discs. In other words, in the present embodiment, programs to be downloaded into the memory including hard discs of the computer provided in the image forming apparatus may be downloaded from portable recording media. Additionally, for example, those programs may be downloaded through a network from a given server provided somewhere (either in the country, abroad, or extra-planetary satellites).

Figure 6:
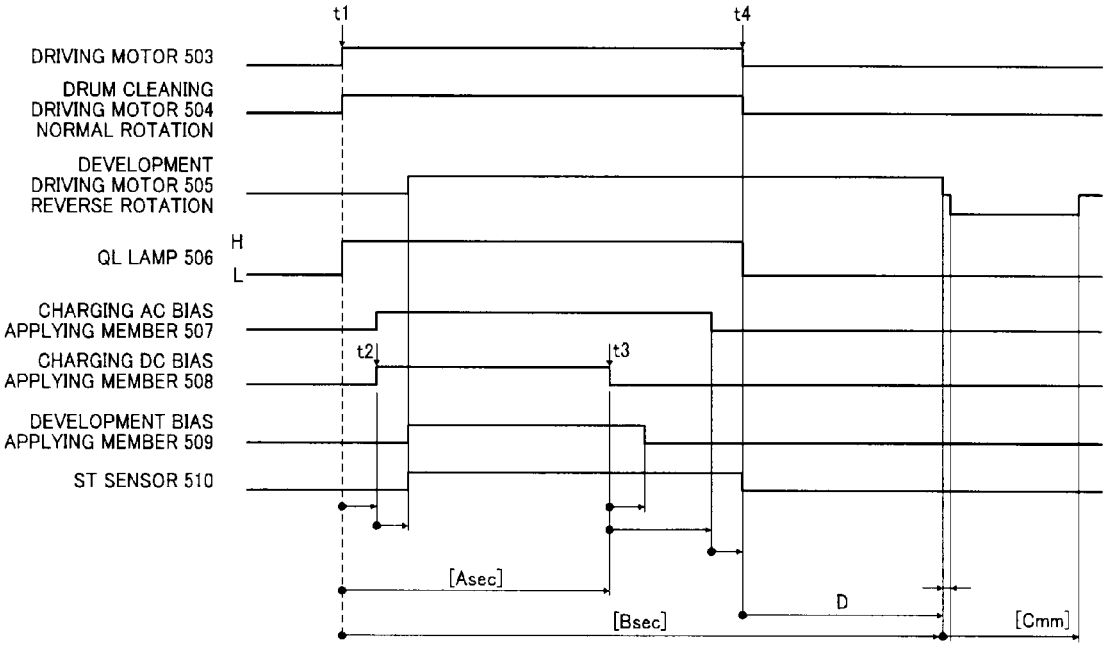
FIG. 6 is a timing chart that schematically illustrates operation of respective parts in an developer removal operation.

The controller 501 controls timing of operations performed by the respective portions in the above-described image forming apparatus as shown in FIG. 6.

FIG. 6 is a timing chart that schematically illustrates timing of operation of the respective parts in developer removal operation from the development device 4 for yellow, magenta, and cyan.

It is preferred that the image forming apparatus automatically perform removal of developer with the development device installed in the image forming apparatus to reduce work of service persons or users. Therefore, in the present embodiment, developer can be automatically collected or removed from the development device 4 installed in the image forming apparatus, and procedure of an automatic developer removal operation is described below.

Referring to FIG. 6, initially, a service person or user presses a button provided in an operation panel (not shown) of the main body 100 to initiate the developer removal operation in a state in which the development device 4 is installed in the main body 100 of the image forming apparatus. Then, the controller 501 starts the driving motor 305 to rotate the photoconductor drum 1 and the charging member. This timing is hereinafter referred to as a trigger pint t1. Simultaneously, the drum cleaning driving motor 504 is activated and the QL lamp 506 is turned on at the trigger point t1. This state is kept until rotation of the photoconductor drum 1 becomes stable.

After rotation of the photoconductor drum 1 is stabilized, the charging AC bias applying member 507 and the charging DC bias applying member 508 apply the charging biases to the photoconductor drum 1 at a trigger point t2. When the charged surface of the photoconductor drum 1 reaches a position facing the development roller 5, the controller 501 starts the development driving motor 505 to rotate the development device 4 in the normal direction and causes the development bias applying member 509 to start applying bias to the development roller 5. Simultaneously with these operations, the shutter 88 is opened, and then the developer circulating in the development device 4 is discharged through the discharge port 13 sequentially.

Thus, in the present embodiment, in an early stage of automatic removal of developer, when removal of developer has not yet progressed and a sufficient amount of developer is carried on the development roller 5, the development device 4 is driven with the photoconductor drum 1 rotating. Therefore, the area of the photoconductor drum 1 subjected to the sliding contact with the developer carried on the development roller 5 is not a given limited area, and thus the photoconductor drum 1 can be prevented from being scratched laterally.

Subsequently, as removal of developer through the discharge port 13 progresses, that is, the amount of developer remaining in the development device 4 decreases, the amount of developer carried on the development roller 5 decreases. More specifically, referring to FIG. 2A, the height of developer in the supply compartment 9 decreases gradually from the downstream side in the conveyance direction of the supply screw 8 to approach zero, and developer is not supplied onto the development roller 5 from the portion where the height of developer is almost zero. Eventually, developer is not supplied to the development roller 5 over the longitudinal length of the development roller 5.

Then, recognizing that almost no developer is carried on the development roller 5, the timing of which is a trigger point t4 shown in FIG. 6, the controller 501 stops the driving motor 503, and thus the photoconductor drum 1 stops rotating. The trigger point t4 at which the driving motor 503 for driving the photoconductor drum 1 and the charging member is stopped can be after the photoconductor drum 1 makes one revolution or greater from a trigger point t3 at which the charging DC bias applying member 508 stops applying the charging DC bias to the photoconductor drum 1 so that electrical charge thereon is removed over the entire circumference thereof. In other words, the trigger point t4 can be after a predetermined period Asec has elapsed from the trigger point t1 at which automatic developer removal operation is started. After rotation of the photoconductor drum 1 is stopped, the controller 501 keeps the development driving motor 505 to rotate in the normal direction to drive the development device 4 until the developer is fully discharged from the development device 4.

Herein, as the amount of toner supplied onto the surface of the photoconductor drum 1 decreases because developer is not carried on the development roller 5, almost no toner is present around an edge portion of a cleaning blade of the drum cleaning unit (not shown). Although the edge portion of the cleaning blade can deform if the photoconductor drum 1 is driven for a long period in such a state, such inconvenience can be prevented with the above-described control.

As described above, when developer is collected from the development device 4, initially the driving motor 503 is started at the trigger point t1, thus rotating the photoconductor drum 1. Subsequently, driving of the development device 4 by the normal rotation of the development driving motor 504 as well as removal of developer are started. Then, at the trigger point 4*t* when the controller 501 recognizes that almost no developer is carried on the development roller 5, the driving motor 503 for driving the photoconductor drum 1 and the charging member is stopped, thereby stopping the photoconductor drum 1. With this control, deformation of the cleaning blade can be prevented or reduced, which can prevent or reduce damage to the cleaning blade and/or the photoconductor drum 1 and cleaning failure as well as secondary malfunction of the device such as noise.

Further, in removal of developer from the development device 4, after the development roller 5 and the three developer conveyance members, the screws 6, 8, and 11, are rotated in the normal directions, thus starting discharge of developer through the discharge port 13, the direction in which the development driving motor 505 rotates is reversed after a predetermined period has elapsed from when the ST sensor 510 detects that almost no toner is carried on the surface of the photoconductor drum 1. In other words, reverse rotation of the development roller 5 as well as the screws 6, 8, and 11 is started after the predetermined period has elapsed from when the ST sensor 510 detects that almost no toner is carried on the surface of the photoconductor drum 1. Reverse rotation of the development roller 5 as well as the screws 6, 8, and 11 is described in further detail later with reference to flowcharts of FIGS. 7 through 12 and 14 and 15.

The chronological order of the reverse rotation of the development driving motor 505 and the driving of the photoconductor drum 1 is as follows. In removal of developer from the development device 4, initially the driving motor 503 is started, thereby starting the photoconductor drum 1 to rotate. Subsequently, the development roller 5 and the screws 6, 8, and 11, are rotated in the normal directions, and simultaneously, the controller 501 checks whether or not the shutter 88 is opened. Recognizing that the shutter 88 is open, the controller 501 starts discharging developer through the discharge port 13. Subsequently, when the ST sensor 510 detects that almost no toner is carried on the surface of the photoconductor drum 1, photoconductor drum 1 is stopped at the trigger point t4 shown in FIG. 6.

Then, after a predetermined period Bsec has elapsed from the trigger point t1 when the driving motor 503 for driving the photoconductor drum 1 and the charging member is started, the direction in which the development driving motor 505 rotates is reversed, and thus the development roller 5 as well as the screws 6, 8, and 11 start rotating in the reverse direction (hereinafter "reverse driving of the development device 4") for a distance Cmm shown in FIG. 6. The distance Cmm is a circumferential length of the development roller 5.

After the development roller 5 as well as the screws 6, 8, and 11 have rotated in the reverse direction for a predetermined period, the discharge port 13 is closed and removal of developer is finished. The predetermined period during which the reverse driving of the development device 4 is performed can determined by dividing the predetermined distance Cmm by a velocity Vin of the reverse rotation.

As shown in FIG. 6, from the start of the developer removal operation to just before completion thereof, the development device 4 is driven in the normal direction identical to the direction in which development device 4 is driven in the development process by driving the development driving motor 505 in the normal direction. Then, after a predetermined period D has elapsed from the trigger point 4 just before the completion of removal of developer, reverse driving of the development driving motor 505 is started. With this control, the developer can be fully discharged from the development device 4 with almost no developer remaining therein.

Next, referring to FIGS. 2A and 2B, description will be given below of agglomeration of developer due to stress when the development device 4 is driven in the normal direction and the reverse direction.

Referring to FIG. 2A, when the screws 6, 8, and 11 rotate in the normal direction, the developer inside the development device 4 is conveyed in the directions indicated by outlined arrows A1, A2, and A3 shown in FIG. 2A while agitated.

In the development device 4 in which the development roller 5 and the three screws 6, 8, and 11 are arranged in a diamond shape on the cross section in which axes of rotation of the development roller 5 and the screws 6, 8, and 11 are cut vertically, a relatively large amount of developer can remain in the downstream end portion 10*e* of the agitation compartment 10 if the development device 4 is driven only in the normal direction for discharging the developer therefrom.

Additionally, although the amount of developer remaining in the development device 4 can be reduced by driving the development device 4 also in the reverse direction, toner can coagulate in the supply compartment 9 if rotation of the screws 6, 8, and 11 are reversed abruptly.

More specifically, when the direction of rotation of the screws 6, 8, and 11 is abruptly reversed from the normal direction, the developer collected from the development roller 5 and the developer transported by the supply screw 8 are transported reversely by the supply screw 8. As a result, a relatively large amount of developer is present at the same time in a specific portion of the supply compartment 9, which can damage the supply screw 8. Even if the supply screw 8 is not damaged, such a large amount of developer can impart a mechanical impact to toner in the developer, thus causing toner therein to coagulate. If remaining in the development device 4 after fresh developer is supplied thereto, the coagulated toner is mixed with the fresh toner, thus producing cores of toner. The number of cores of toner can be amplified and degrade image quality.

Additionally, after the driving of the development device 4 in the normal direction is started, thus starting removal of developer, in the early stage, developer accumulates in the downstream end portion 10*e* of the agitation compartment 10 disposed beneath the supply compartment 9 and is pushed upward through the third communication portion from the agitation compartment 10 to the supply compartment 9 as indicated by arrow D shown in FIG. 2B similarly to the development process. The developer transported to the supply compartment 9 is transported through the circulation path in the development process together with the developer in the supply compartment 9 as well as the collection compartment 7 and then is discharged through the discharge port 13 outside the device.

The amount of developer remaining in the development device 4 decreases as removal of developer progresses. After the trigger point t4 shown in FIG. 6, although almost no developer is conveyed from the lower agitation compartment 10 to the upper supply compartment 9 through the third communication portion, developer still remains in an area from the downstream side in the agitation compartment 10 to the discharge port 13. Because the developer remaining in the agitation compartment 10 is pushed downstream by the agitation screw 11 in a state in which no developer is conveyed upward from the agitation compartment 10 to the supply compartment 9 through the third communication portion, toner can coagulates in the downstream end portion 10*e* shown in FIG. 2B. In other words, it is possible that coagulated toner can remain in the development device 4 after developer removal operation is finished. If fresh developer is supplied to the development device 4 in which the coagulated toner remains, substandard images in which the coagulated toner form cores of toner can be produced through subsequent image formation.

By contrast, in the present embodiment, because rotation of the screws 6, 8, and 11 is reversed before completion of the developer removal operation, the developer including coagulated toner remaining in the downstream end portion 10*e* is conveyed by the reverse rotation of the agitation screw 11 to the left in FIG. 2B. Subsequently, the developer is conveyed to the right in FIG. 2B by the reverse rotation of the collection screw 6 and discharged through the discharge port 13 outside the device. Herein, reverse driving of the development device 4 is started after developer is fully removed from the supply compartment 9 and from the portion extending upstream from the discharge port 13 in the collection compartment 7.

Further, with reverse rotation of the three screws 6, 8, and 11, the developer remaining in the area extending from the downstream end portion of the agitation compartment 10 in the developer conveyance direction therein to the discharge port 13 can be discharged. Thus, the developer can be fully discharged from the development device 4.

It is to be noted that, the cost of the image forming apparatus can be reduced using existing components for other purposes. Therefore, in the present embodiment, whether or not developer is carried on the development roller 5, that is, whether or not the discharge port 13 is open, can be detected by the ST sensor 510, the photoconductor driving torque detector 513 for detecting torque of the photoconductor drum 1, or the development driving torque detector 512 for detecting torque of the development device 4.

The ST sensor 510 functions as a toner concentration detector that detects the concentration of toner in the developer based on changes in magnetic permeability of the developer. In addition, in the developer removal operation, the ST sensor 510 detects whether or not developer is carried on the development roller 5 by detecting changes in the amount of adjacent developer based on changes in magnetic permeability of the developer. More specifically, referring to FIG. 6, after removal of developer is started, when the magnetic permeability detected by the ST sensor 510 has reached a predetermined value at the trigger point t4, the controller 501 determines that no developer is carried on the development roller 5 and stops the driving motor 503 for the photoconductor drum 1 and the charging roller, thereby stopping rotating the photoconductor drum 1. Alternatively, after removal of developer is started, when a predetermined period has elapsed from when the value detected by the ST sensor 510 or the discharge port detector 511 has reached a predetermined value, the controller 501 may determine that no developer is carried on the development roller 5 and stop the photoconductor drum 1.

Next, various embodiments regarding removal of developer are described below.

First Embodiment

Figure 7:
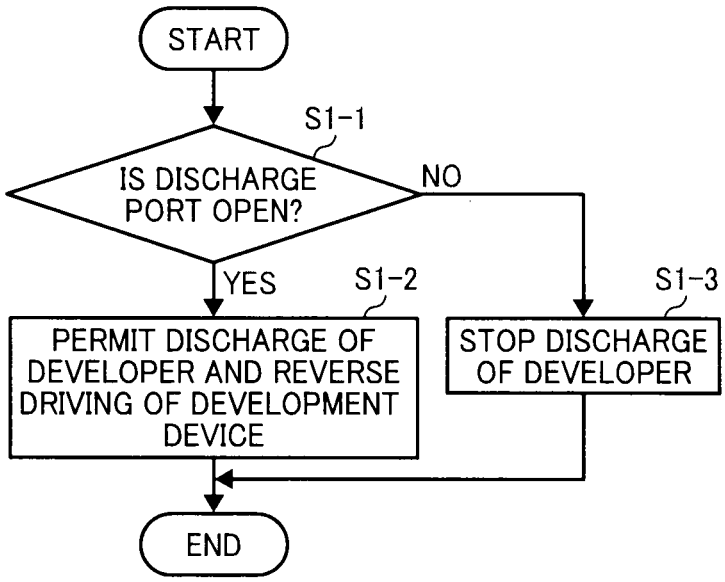
FIG. 7 is a flowchart of the developer removal operation according to a first embodiment.

A first embodiment is described below with reference to FIG. 6 and a flowchart shown in FIG. 7.

Referring to FIG. 6, when the service person presses the button provided in the operation panel (not shown) of the main body 100 of the image forming apparatus for discharging used developer from the development device 4, the controller 501 initiate the developer removal operation automatically. At S1-1, the controller 501 checks whether or not the discharge port 13 is open based on the detection result generated by the discharge port detector 511. Recognizing that the discharge port 13 is open (YES at S1-1), at S1-2, the controller 501 permits discharge of developer from the development device 4 as well as reverse driving of the development device 4, thus initiating removal of developer. By contrast, when the discharge port 13 is not opened (NO at S1-1), at S1-3 the controller 501 terminates the developer removal operation without performing discharge of developer.

With this determination step, discharge of developer is not initiated when the discharge port 13 is closed, thus preventing an error. As a result, coagulation of developer or damage to the development device 4 can be prevented.

In the present embodiment, the discharge port detector 511 detects whether or not the shutter 88 (shown in FIG. 3) that opens and closes the discharge port 13 is open. The discharge port detector 511 may detect the state of the shutter 88 electrically, mechanically, or optically. Additionally, the type, mechanism, and theory of detection of the discharge port detector 511 are not limited to specific examples. Examples of the discharge port detector 511 that perform either direct detection or indirect detection will be given in other embodiments of operation described later.

As described above, because the controller 501 terminates the developer removal operation at S1-3 in the first embodiment when the discharge port 13 is not open, reverse driving of the development device 4 without discharging any developer therefrom can be prevented. Therefore, coagulation of developer and damage to the development device 4 can be prevented or reduced. It is to be noted that, even if the developer is not discharged from the development device 4, coagulation of developer and damage to the development device 4 are not caused as long as the development device 4 is driven in the normal direction because developer is circulated therein. Therefore, the state of the discharge port 13 may be detected after discharge of developer is initiated although this detection is performed after discharge of developer is initiated in the flowchart shown in FIG. 7.

Additionally, it is preferable that detection by the ST sensor 510 for detecting the concentration of toner in the developer be used to determine whether or not developer is carried on the development roller 5, based on which reverse driving of the development device 4 is permitted or discharge of developer is discontinued. It is preferable that presence of developer on the development roller 5, that is, whether or not the discharge port 13 is open, be detected indirectly using the ST sensor 510 after the trigger point t4 or after the predetermined period Bsec has elapsed from the trigger point t1 at which the developer removal operation is started. By using the ST sensor 510 in this determination, reverse driving of the development device 4 can be allowed only after developer is fully discharged from the development device 4 in the present embodiment. Therefore, compression of toner does not occur. Even when toner coagulates, such coagulated toner can be discharged from the development device 4, and accordingly coagulated toner is not mixed with fresh developer supplied to the development device 4.

Second Embodiment

Figure 8:
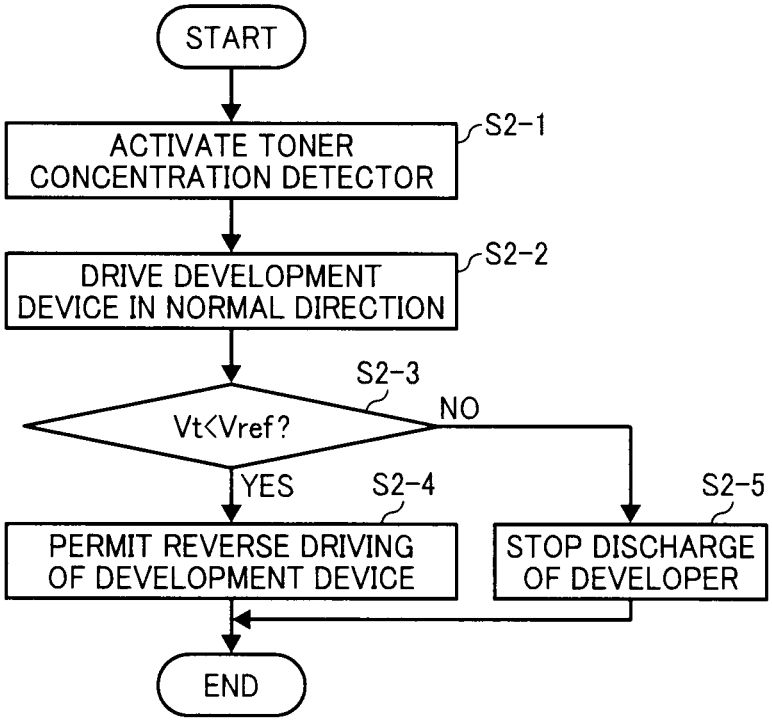
FIG. 8 is a flowchart of a developer removal operation according to a second embodiment.

A second embodiment is described below with reference to a flowchart shown in FIG. 8.

Similarly to the first embodiment described above, when the service person presses the button in the operation panel (not shown) of the main body 100 of the image forming apparatus, the controller 501 initiates the developer removal operation automatically. At S2-1, the controller 501 activates the toner concentration detector that in the present embodiment is the ST sensor 510. The ST sensor 510 that converts changes in magnetic permeability into toner concentration can serve as the toner concentration detector.

The ST sensor 510 detects changes in the ratio of toner particles to magnetic carrier particles from changes in magnetic permeability. The magnetic permeability is low when the amount of toner particles is large and increases as the toner concentration decreases. Additionally, magnetic permeability is significantly low when almost no developer is present in the development device 4. In the second embodiment, presence of developer is detected using this characteristic. As shown in FIGS. 6 and 8, at S2-2 the development driving motor 505 is operated for the predetermined period Bsec from the trigger point t1 at which the developer removal operation is initiated.

Then, before direction of driving of the development device 4 is reversed, at S2-3 the controller 501 checks whether or not developer around the toner concentration detector has been discharged at S2-2, that is, an output value Vt of the toner concentration detector has reduced lower than a predetermined value Vref. When the output value Vt of the toner concentration detector is lower than the predetermined value Vref (YES at S2-3), determining that no developer is present in the development device 4 and on the development roller 5 or the amount is significantly reduced, the controller 501 permits reverse driving of the development device 4 at S2-4. By contrast, when the controller 501 determines that a certain amount of developer is present in the development device 4 and on the development roller 5 (NO at S2-3), the direction of driving of the development device 4 is not reversed and the developer removal operation is terminated at S2-5.

Although the service person or user might start discharging developer from the development device 4 without opening the discharge port 13, such a human error can be eliminated in the control according to the present embodiment.

Additionally, because not a dedicated detector but the toner concentration detector (i.e., ST sensor 510) is used to check the presence of developer in the development device 4, the cost of the device does not increase, and reconsideration in designing the device or the image forming apparatus for the location of such a detector as well as securing the space for the detector are not necessary.

The second embodiment is an example in which the presence of developer in the development device 4 is detected indirectly. Also in this embodiment, even if the developer is not discharged from the development device 4, coagulation of developer and damage to the development device 4 are not caused as long as the development device 4 is driven in the normal direction because developer is circulated therein.

Third Embodiment

Figure 9:
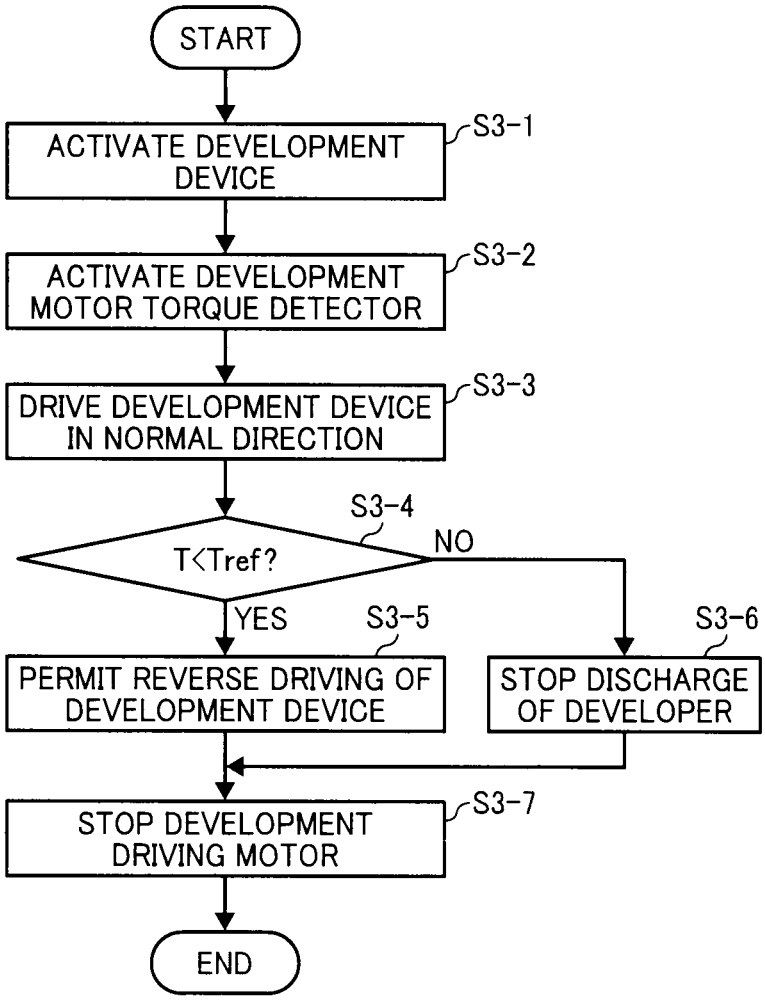
FIG. 9 is a flowchart of a developer removal operation according to a third embodiment.

A third embodiment is described below with reference to FIG. 9.

Similarly to the above-described embodiments, when the service person presses the button in the operation panel (not shown) of the main body 100 of the image forming apparatus, the controller 501 initiates the developer removal operation automatically. At S3-1, the controller 501 activates the development device 4 and, at S3-2, activates the development driving torque detector 512 of the development device 4.

At S3-3, to discharge the developer whose useful life has expired from the development device 4, the development device 4 is driven in the normal direction for the predetermined period, after which the controller 501 checks whether or not the direction of driving of the development device 4 is reversed. The development driving torque detector 512 is used in this determination.

More specifically, the development driving torque detector 512 monitors the driving current of the development driving motor 505 shown in FIG. 6 and calculates the torque based on the monitored driving current. The development driving torque detector 512 is used to check whether or not the development driving motor 525 or the development device 4 operates normally. The driving current is small when the load of the development driving motor 505 is small and increases as the driving load increases. Accordingly, the torque of the development driving motor 505 is small when no developer is present in the development device 4 and is large when the development device 4 is filled with developer. The presence of developer in the development device 4 is detected using this theory.

At S3-4, the controller 501 determines that no or almost no developer is present in the development device 4 when the calculated torque is smaller than a threshold Tref and determines that developer is present in the development device 4 when the calculated torque is greater than the threshold Tref. Determining that no or almost no developer is present in the development device 4 (YES at S3-4), the controller 501 permits reverse driving of the development device 4 at S3-5. By contrast, determining that developer is present in the development device 4 (NO at S3-4), the controller 501 does not permits reverse driving of the development device 4 and finishes discharging developer from the development device 4 at S3-6.

Although the service person or user might start discharging developer from the development device 4 without opening the discharge port 13, such a human error can be eliminated in the control according to the present embodiment. It is to be noted that after S3-5 or S3-6, at S3-7 the development driving motor 505 is stopped and the develop removal operation is completed.

Additionally, because not a dedicated detector but the development driving torque detector 512 is used to check the presence of developer in the development device 4, similarly to the above-described second embodiment, the cost of the device does not increase, and reconsideration in designing the device or the image forming apparatus for the location of such a detector as well as securing the space for the detector are not necessary. The third embodiment is an example using indirect sensing for detecting the presence of developer in the development device 4 as well.

It is to be noted that, even if the developer is not discharged from the development device 4, coagulation of developer and damage to the development device 4 are not caused when the development device 4 is driven in the normal direction because developer is circulated therein.

Fourth Embodiment

Referring to a flowchart shown in FIG. 10, a fourth embodiment is described below. Similarly to the third embodiment described above, when the service person presses the button in the operation panel (not shown) of the main body 100 of the image forming apparatus, the controller 501 initiates the developer removal operation automatically.

Figure 10:
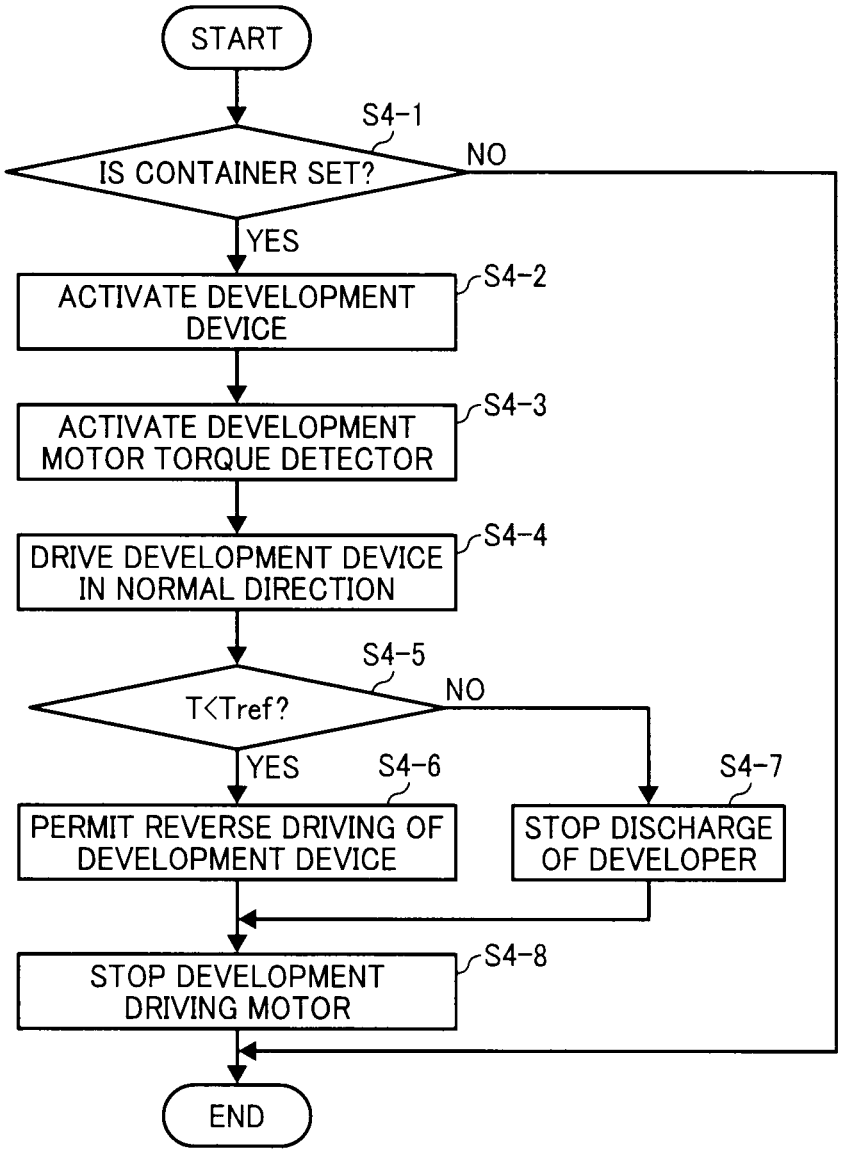
FIG. 10 is a flowchart of a developer removal operation according to a fourth embodiment.

As shown in FIG. 10, at S4-1 the controller 501 checks whether or not the waste developer container 40 for containing used developer is set in the image forming apparatus. When the waste developer container 40 is set (YES at S4-1), at S4-2 the development device 4 is activated. At S4-3, the development driving torque detector 512 is activated. At S4-4, the development device 4 is driven in the normal direction for the predetermined period. Subsequently, whether the reverse driving of the development device 4 is permitted is determined at S4-5. The development driving torque detector 512 is used in this determination.

Steps performed at S4-5 to S4-8 are similar to those performed at S3-4 to S3-7 in the above-described third embodiment, and thus description thereof is omitted. It is to be noted that, at S4-1, if the waste developer container 40 is not set, the developer removal operation is terminated.

Although the service person or user might start discharging developer from the development device 4 without opening the discharge port 13, such a human error can be eliminated in the control according to the present embodiment.

Additionally, because not a dedicated detector but the development driving torque detector 512 is used to check the presence of developer in the development device 4, similarly to the above-described embodiments, the cost as well as the size of the device can be reduced. Further, because the discharged developer can be surely collected in the waste developer container 40, the interior and adjacent areas of the device can be kept clean.

It is to be noted, although the developer removal operation is terminated when the waste developer container 40 is not set at S4-1 in the description above, alternatively, a step of setting the waste developer container 40 and a step of confirming that the waste developer container 40 is set properly may be added, after which the procedure may proceed to the step S4-2. Such a flow is within the range of the fourth embodiment.

Fifth Embodiment

A fifth embodiment is described below with reference to FIG. 11.

Similarly to the above-described embodiments, the service person or user presses the button in the operation panel (not shown) of the main body 100 of the image forming apparatus to execute removal of developer from the development device 4. Then, the controller 501 initiates the developer removal operation automatically. The fifth embodiment is based on the above-described second embodiment and includes a step of checking whether the intermediate transfer belt 110 is disengaged from the photoconductor drum 1 in tandem-type image forming apparatuses in which multiple image forming units are provided and the intermediate transfer belt 110 can be disengaged from the photoconductor drum 1.

Figure 11:
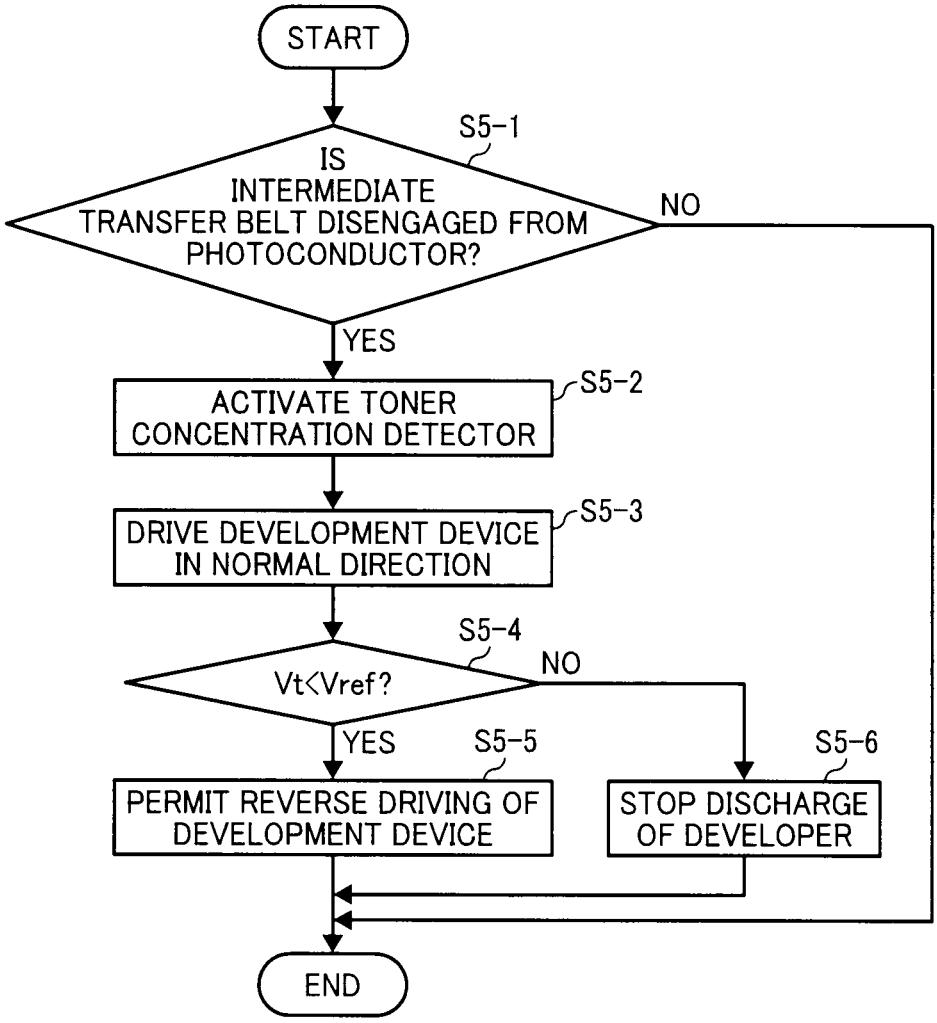
FIG. 11 is a flowchart of a developer removal operation according to a fifth embodiment.

Referring to FIG. 11, at S5-1, the controller 501 checks whether or not the intermediate transfer belt 110 is disengaged from the photoconductor drum 1.

Whether the intermediate transfer belt 110 is disengaged from the photoconductor drum 1 is thus determined, and, when the intermediate transfer belt 110 is disengaged from the photoconductor drum 1 (YES at S5-1), at S5-2 the toner concentration detector is activated. At S5-3, the development device 4 is driven in the normal direction for the predetermined period. Subsequently, steps similar to those performed from S2-3 to S2-5 in the second embodiment are performed from S5-4 to S5-6. In the fifth embodiment, human errors that the service person or user forgets to open the discharge port 13 before starting discharging developer from the development device 4 can be eliminated. Additionally, another human error that the service person or user forgets to disengage the intermediate transfer belt 110 from the photoconductor drum 1 before starting discharging developer from the development device 4 can be eliminated. It is to be noted that, when the intermediate transfer belt 110 is in contact with the photoconductor drum 1 (NO at S5-1), the developer removal operation is terminated.

Sixth Embodiment

Figure 12:
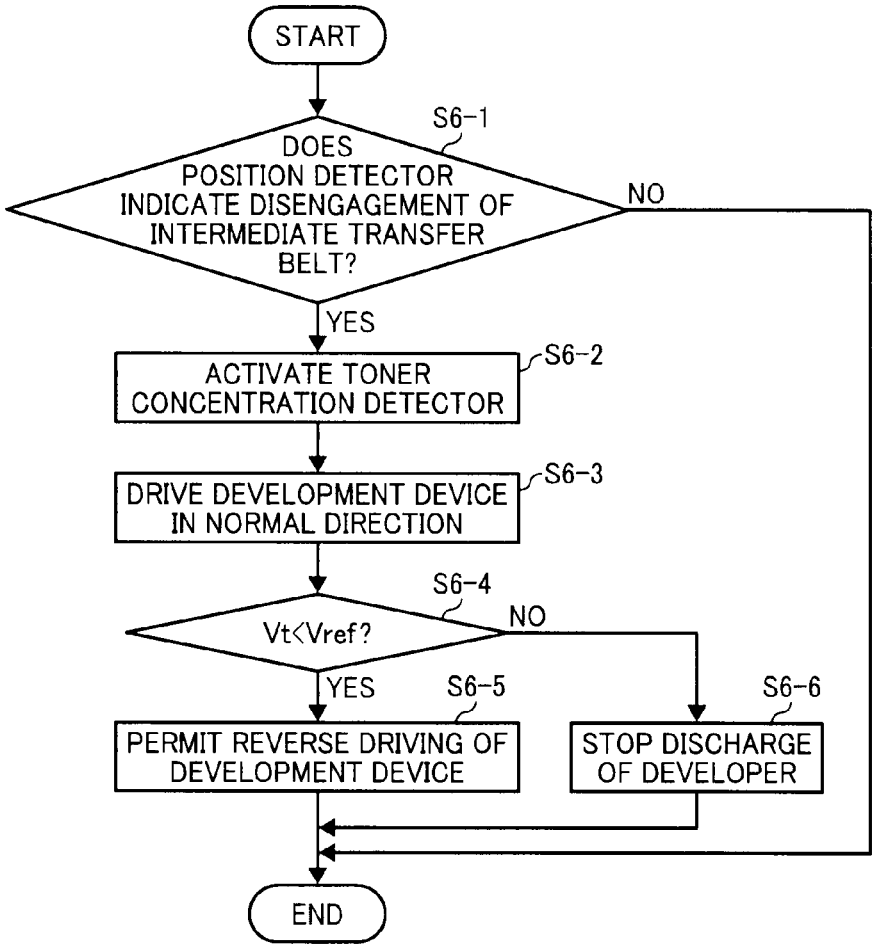
FIG. 12 is a flowchart of a developer removal operation according to a sixth embodiment.

Referring to a flowchart shown in FIG. 12, a sixth embodiment is described below.

Similarly to the first through fifth embodiments described above, when the service person presses the button in the operation panel (not shown) of the main body 100 of the image forming apparatus, the controller 501 initiates the developer removal operation automatically. The sixth embodiment is for the tandem-type image forming apparatuses similarly to the fifth embodiment. Steps performed from S6-1 to S6-6 shown in FIG. 12 are similar to those performed from S5-1 to S5-6 shown in FIG. 11 except that the position sensor 516 (shown in FIG. 5) is used to check disengagement of the intermediate transfer belt 110 from the photoconductor drum 1 at S6-1, and thus description thereof is omitted.

For example, the position sensor 516 can be a sensor similar to the photosensor (cam position detector 94) and positioned at a position capable of detecting the position of the first pivotable arm 70 shown in FIG. 4 so as to acquire the position of the intermediate transfer belt 110.

In the sixth embodiment, human errors that the service person or user forgets to open the discharge port 13 before starting discharging developer from the development device 4 can be eliminated. Additionally, another human error that the service person or user forgets to disengage the intermediate transfer belt 110 from the photoconductor drum 1 before starting discharging developer from the development device 4 can be eliminated.

Seventh Embodiment

Figure 13:
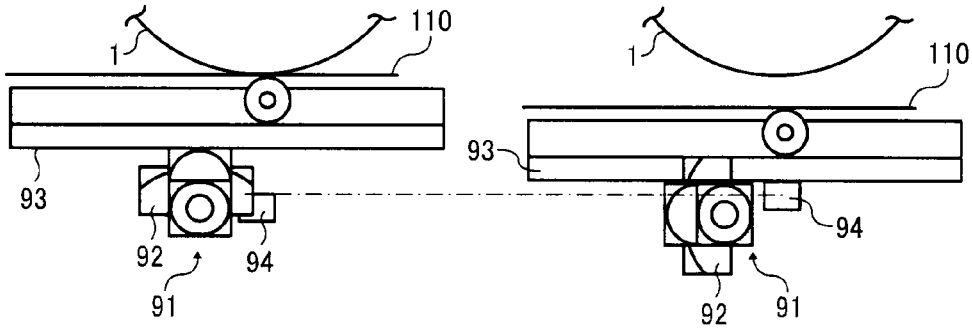
FIG. 13 is a schematic view of an engagement and disengagement mechanism between the intermediate transfer belt and the photoconductor drum.

Referring to FIG. 13 and a flowchart shown in FIG. 14, a seventh embodiment is described below.

Figure 14:
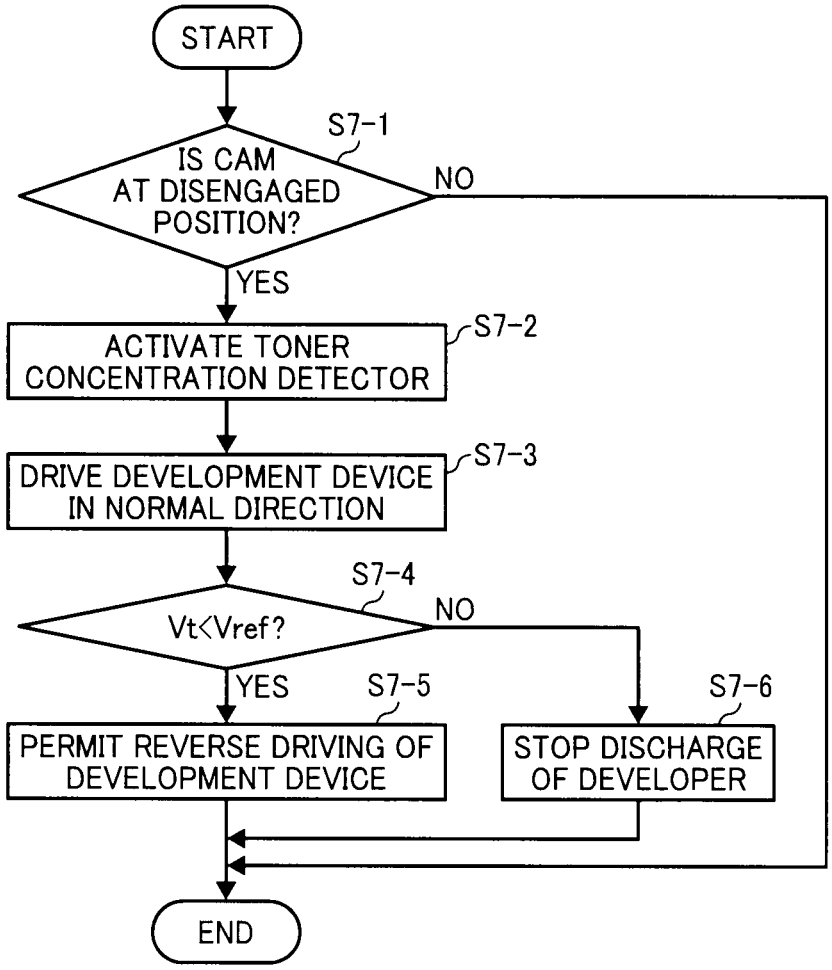
FIG. 14 is a flowchart of a developer removal operation according to a seventh embodiment.

The seventh embodiment shown in FIG. 14 is for tandem-type image forming apparatuses in which the intermediate transfer belt 110 can be disengaged from the photoconductor drum 1. Steps performed from S7-1 to S7-6 shown in FIG. 14 are similar to those performed from S6-1 to S6-6 shown in FIG. 12 except that a cam position detector 94 is used at S7-1 instead of the position sensor 516, and thus description thereof is omitted.

An engagement and disengagement mechanism between the intermediate transfer belt 110 and the photoconductor drums 1, used in this determination is described below with reference to FIG. 13.

The engagement and disengagement mechanism shown in FIG. 13 includes a bracket 93, a disengagement cam 91, and a disengagement detector or cam position detector 94. The disengagement cam 91 can be rotated by a motor, not shown, or manually. By rotating the disengagement cam 91, the bracket 93 supporting the primary-transfer roller 62 is moved, thereby engaging and disengaging the intermediate transfer belt 110 from the photoconductor drum 1. The disengagement detector 94 that in the present embodiment is a photosensor to detect the rotational position of the cam 91 and thus detects whether the intermediate transfer belt 110 is disengaged from the photoconductor drum 1.

The disengagement detector 94 may includes a light-emitting element and a light-receiving element and directly detect an engagement state with the receipt of light by the light-receiving element. In the state shown in FIG. 13, in which a projection of the disengagement cam 91 pushes up the bracket 93, the intermediate transfer belt 110 is disengaged from the photoconductor drum 1. In this state, a filler 92 integrated to the disengagement cam 91 as a single unit blocks optical beam omitted from the disengagement detector 94, and thus the disengagement detector 94 recognizes that the filler 92 is present at a predetermined position. Then, with the output from the disengagement detector 94 in that state, the controller 501 determines that the intermediate transfer belt 110 is in contact with the photoconductor drum 1.

By contrast, in the state shown in FIG. 13B, the disengagement detector 94 determines that the filler 92 is not present at the predetermined position, and accordingly the controller 501 determines that the intermediate transfer belt 110 is disengaged from the photoconductor drum 1.

At S7-1, whether or not the intermediate transfer belt 110 is disengaged from the photoconductor drum 1 is determined using the disengagement detector or cam position detector 94. Except that the disengagement detector 94 is used in the determination of S7-1, steps performed from S7-1 to S7-6 are similar to those performed from S5-2 to S5-6 shown in FIG. 11, and thus description thereof omitted.

In the seventh embodiment, human errors that the service person or user forgets to open the discharge port 13 before starting discharging developer from the development device 4 can be eliminated. Additionally, another human error that the service person or user forgets to disengage the intermediate transfer belt 110 from the photoconductor drum 1 before starting discharging developer from the development device 4 can be eliminated.

Moreover, because existing disengagement mechanisms cam be used to determine whether or not the intermediate transfer belt 110 is disengaged from the photoconductor drum 1, the cost does not increase. It is to be noted that the discharge port detector 511 may be a direct sensor (not shown) or an indirect sensor such the magnetic permeability detector (ST sensor) 510, the development driving torque detector 512, or the like.

Eighth Embodiment

Figure 15:
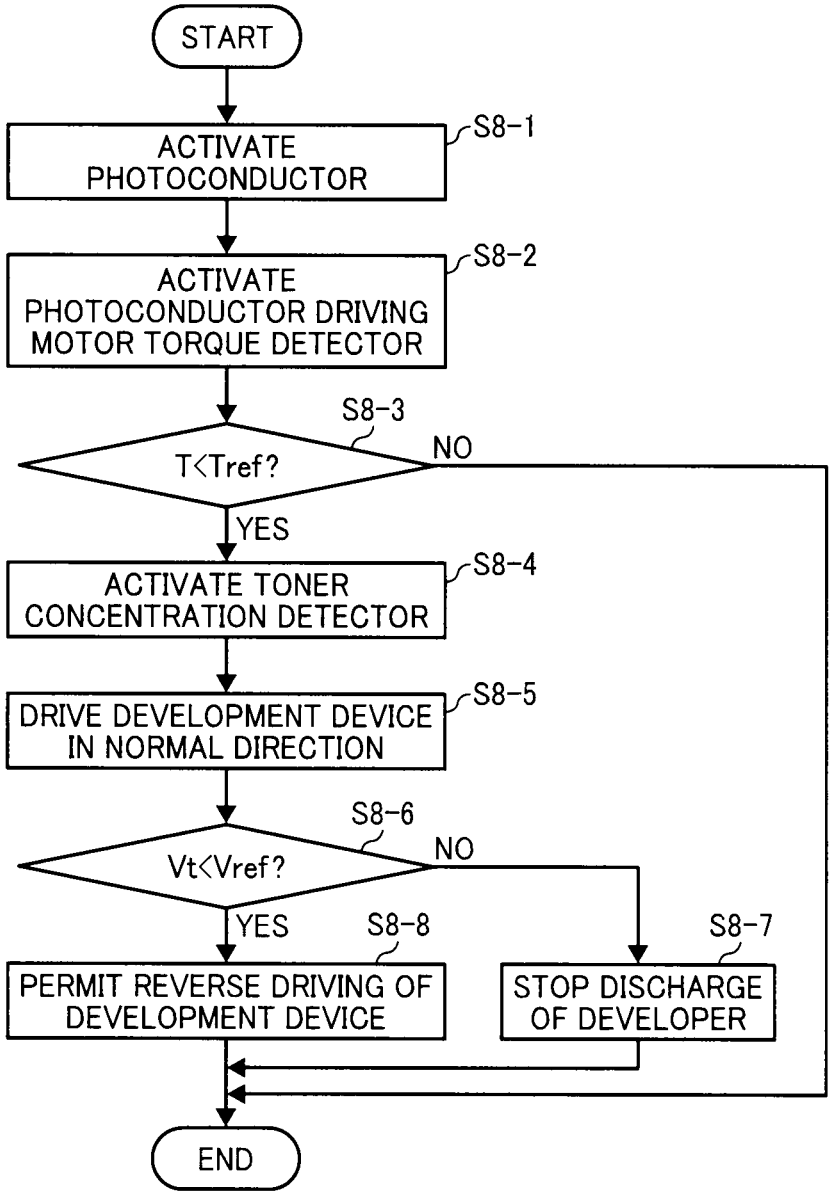
FIG. 15 is a flowchart of a developer removal operation according to a eighth embodiment.

Referring to a flowchart shown in FIG. 15, a eighth embodiment is described below.

Similarly to the embodiments described above, when the service person presses the button in the operation panel (not shown) of the main body 100 of the image forming apparatus, the controller 510 initiates the developer removal operation automatically. The seventh embodiment shown in FIG. 15 is for tandem-type image forming apparatuses in which the intermediate transfer belt 110 can be disengaged from the photoconductor drums 1 and similar to the procedure shown in FIGS. 12 and 14 except that disengagement of the intermediate transfer belt 110 is determined based on the torque of the driving motor 503 for driving the photoconductor drum 1.

At S8-1, the driving motor 503 for driving the photoconductor drum 1 and the charging member is activated, and at S8-2 the photoconductor driving torque detector 513 (second torque detector) is activated. At S8-3, the controller 501 checks whether or not a torque T detected by the photoconductor driving torque detector 513 is smaller than a threshold Tref. More specifically, when the intermediate transfer belt 110 is in contact with the photoconductor drum 1, which is a state for forming images, the intermediate transfer belt 110 is pressed against the photoconductor drum 1 by the respective primary-transfer rollers 62, and accordingly the driving torque of the photoconductor drum 1 is larger. When the detected torque T is greater than the threshold Tref (NO at S8-3), the controller 501 determines that the intermediate transfer belt 110 is in contact with the photoconductor drum 1. By contrast, when the detected torque T is smaller than the threshold Tref (YES at S8-3), the controller 501 determines that the intermediate transfer belt 110 is disengaged from the photoconductor drum 1. Subsequently, steps similar to S7-2 through S7-6 are performed at steps S8-4 through S8-8.

Discharge of developer from the development device 4 is executed based on the determination whether the intermediate transfer belt 110 is disengaged from the photoconductor drum 1. With this determination, human errors that the service person or user forgets to disengage the intermediate transfer belt 110 from the photoconductor drum 1 before starting discharging developer from the development device 4 can be eliminated.

It is to be noted that, alternatively, disengagement of the intermediate transfer belt 110 may be checked based on the detection results generated by the belt driving torque detector 514 instead of those generated by the photoconductor driving torque detector 513.

Moreover, because the existing photoconductor driving torque detector 513 is used to determine whether the intermediate transfer belt 110 is disengaged form the photoconductor drum 1, the cost does not increase. Generally, the photoconductor driving torque detector 513 is used for detecting abnormal states in which the load of the driving motor 503 is excessively large. The photoconductor driving torque detector 513 may be a detector for detecting driving current.

As described above, in the present embodiment, whether the discharge port 13 through which used developer is discharged is open can be checked automatically in replacement of two-component developer, coagulation of toner due to reverse driving of the development device 4 as well as scattering of toner inside the image forming apparatus can be prevented or alleviated. Thus, failure of the apparatus and damage to the device can be reduced.

As described above, because developer can be discharged automatically from the development device 4 installed in the image forming apparatus, the time required to remove developer and downtime of the image forming apparatus can be reduced.

Additionally, the above-described embodiments can be configured as computer program products for executing the procedures of developer removal operation shown in FIGS. 8 through 12, 14, and 15. Such computer programs may be stored in servers or computer-readable recording media and downloaded therefrom either directly or indirectly through a network to image forming apparatuses. Then, according to the program codes thus downloaded, the developer removal operation may be executed in that image forming apparatus or other image forming apparatus than the image forming apparatus to which the program codes are downloaded. Additionally, although the description above concerns the configuration in which photoconductor drums 1 are used as image carriers, image carriers are not limited thereto, and, alternatively, photoconductive belts or the like may be used.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image forming unit including a latent image carrier and a development device to develop a latent image formed on the latent image carrier with developer, the development device comprising:

a developer carrier disposed facing the latent image carrier, to carry the developer to the latent image carrier by rotation;

a discharge port through which the developer is discharged outside the development device;

a discharge port detector to detect whether the discharge port is open; and a controller operatively connected to the development device and the discharge port detector for performing discharge of developer from the development device, wherein, in the discharge of developer, the controller determines whether to permit driving of the development device in a direction reverse to a normal direction in which the development device is driven in image formation or to terminate the discharge of developer based on detection results obtained by the discharge port detector, wherein the discharge port detector comprises a toner concentration detector for detecting a concentration of toner in the developer in the development device, and wherein the discharge port detector determines whether the discharge port is open or closed by comparing an output from the toner concentration detector with a predetermined threshold.

2. The image forming apparatus according to claim 1, wherein the toner concentration detector is a magnetic permeability detector.

3. An image forming apparatus comprising:

an image forming unit including a latent image carrier and a development device to develop a latent image formed on the latent image carrier with developer, the development device comprising:

a developer carrier disposed facing the latent image carrier, to carry the developer to the latent image carrier by rotation;

a discharge port through which the developer is discharged outside the development device:

a discharge port detector to detect whether the discharge port is open; and a controller operatively connected to the development device and the discharge port detector for performing discharge of developer from the development device, wherein, in the discharge of developer, the controller determines whether to permit driving of the development device in a direction reverse to a normal direction in which the development device is driven in image formation or to terminate the discharge of developer based on detection results obtained by the discharge port detector, wherein the discharge port detector comprises a torque detector for detecting a driving torque of the development device, and wherein the discharge port detector determines whether the discharge port is open or closed by comparing the driving torque of the development device detected by the torque detector with a predetermined threshold.

4. An image forming apparatus comprising:

an image forming unit including a latent image carrier and a development device to develop a latent image formed on the latent image carrier with developer, the development device comprising:

a developer carrier disposed facing the latent image carrier, to carry the developer to the latent image carrier by rotation;

a discharge port through which the developer is discharged outside the development device;

a discharge port detector to detect whether the discharge port is open; and a controller operatively connected to the development device and the discharge port detector for performing discharge of developer from the development device, wherein, in the discharge of developer, the controller determines whether to permit driving of the development device in a direction reverse to a normal direction in which the development device is driven in image formation or to terminate the discharge of developer based on detection results obtained by the discharge port detector, wherein the image forming apparatus further comprises a waste developer container detector for detecting whether a waste developer container is set in the image forming apparatus, and wherein the discharge port detector determines whether the discharge port is open or closed after the waste developer container detector determines that the waste developer container is set in the image forming apparatus.

5. An image forming apparatus comprising:

an image forming unit including a latent image carrier and a development device to develop a latent image formed on the latent image carrier with developer, the development device comprising:

a developer carrier disposed facing the latent image carrier, to carry the developer to the latent image carrier by rotation;

a discharge port through which the developer is discharged outside the development device;

a discharge port detector to detect whether the discharge port is open; and a controller operatively connected to the development device and the discharge port detector for performing discharge of developer from the development device, wherein, in the discharge of developer, the controller determines whether to permit driving of the development device in a direction reverse to a normal direction in which the development device is driven in image formation or to terminate the discharge of developer based on detection results obtained by the discharge port detector, wherein the image forming apparatus further comprises:

an intermediate transfer member;

a disengagement mechanism to engage and disengage the intermediate transfer member from the latent image carrier; and a disengagement detector to detect whether the intermediate transfer member is disengaged from the latent image carrier, wherein the image forming unit is a tandem type and includes multiple latent image carriers, and wherein the discharge port detector determines whether the discharge port is open or closed after the disengagement detector determines that the intermediate transfer member is disengaged from the latent image carrier.

6. The image forming apparatus according to claim 5, wherein the disengagement detector comprises one of a position detector to detect a position of the intermediate transfer member, a torque detector for detecting a driving torque of the latent image carrier, and a torque detector for detecting a driving torque of the intermediate transfer member.

7. The image forming apparatus according to claim 5, wherein the disengagement mechanism to engage and disengage the intermediate transfer member from the latent image carrier comprises:

a cam to move the intermediate transfer member with a rotational position thereof; and a cam position detector to detect the rotational position of the cam, wherein the disengagement detector detects whether the intermediate transfer member is disengaged from the latent image carrier based on an output from the cam position detector.

8. A method of discharging developer from a discharge port formed in a development device installed in an image forming apparatus, the method comprising:

a step of driving the development device for a predetermined period in a normal direction in which the development device is driven in image formation;

a step of detecting whether the discharge port is open or closed;

a step of determining whether to permit driving of the development device in a direction reverse to the normal direction or to terminate the discharge of developer based on whether or not the discharge port is open;

a step of driving the development device in a reverse direction opposite the normal direction when the discharge port is open; and a step of detecting whether an intermediate transfer member is disengaged from a latent image carrier before the step of detecting whether the discharge port is open or closed.

9. The method according to claim 8, wherein the step of detecting whether the discharge port is open comprises:

detecting a magnetic permeability of developer in the development device to determine an amount of developer in the development device; and comparing the detected magnetic permeability of the developer with a predetermined threshold.

10. The method according to claim 8, wherein the step of detecting whether the discharge port is open or closed comprises:

detecting driving torque of the development device; and comparing a detected driving torque of the development device with a predetermined threshold.

11. The method according to claim 8, further comprising a step of detecting whether a waste developer container is set in the image forming apparatus before the step of detecting whether the discharge port is open or closed.

12. The method according to claim 8, wherein the step of detecting whether the intermediate transfer member is disengaged comprises one of detecting a position of the intermediate transfer member, detecting a driving torque of the intermediate transfer member, and detecting a driving torque of the latent image carrier.

13. The method according to claim 8, wherein the step of detecting whether the intermediate transfer member is disengaged comprises detecting a rotational position of a cam that moves the intermediate transfer member with a rotational position thereof.

14. An image forming apparatus comprising:

an image forming unit including a latent image carrier and a development device to develop a latent image formed on the latent image carrier with developer, the development device comprising:

a developer carrier disposed facing the latent image carrier, to carry the developer to the latent image carrier by rotation;

a discharge port through which the developer is discharged outside the development device;

a discharge port detector to detect whether the discharge port is open; and a controller operatively connected to the development device and the discharge port detector for performing discharge of developer from the development device, wherein, in the discharge of developer, the controller determines whether to permit driving of the development device in a direction reverse to a normal direction in which the development device is driven in image formation or to terminate the discharge of developer based on detection results obtained by the discharge port detector, the image forming apparatus further comprising:

a partition dividing an interior of the development device into a supply compartment, a collection compartment disposed lower than the supply compartment, and an agitation compartment disposed at a height similar to that of the collection compartment;

a developer supply member disposed in the supply compartment facing the developer carrier, to supply the developer to the developer carrier while transporting the developer in an axial direction of the developer carrier;

a developer collection member disposed in the collection compartment facing the developer carrier, to transport the developer separated from the developer carrier in a developer conveyance direction identical to the direction in which the developer supply member transports the developer; and a developer agitation member disposed in the agitation compartment facing the supply compartment as well as the collection compartment, the agitation compartment receiving excessive developer from a downstream end portion of the supply compartment in the developer conveyance direction therein as well as collected developer from a downstream end portion of the collection compartment in the developer conveyance direction therein, the developer agitation member mixing together the excessive developer and the collected developer and transporting the mixed developer in a direction opposite the direction in which the developer supply member transports the developer.

* * * * *